US006848401B2

(12) United States Patent
Takenaka et al.

(10) Patent No.: US 6,848,401 B2
(45) Date of Patent: Feb. 1, 2005

(54) VALVE TIMING ADJUSTING DEVICE

(75) Inventors: Akihiko Takenaka, Anjo (JP); Michio Adachi, Obu (JP); Takayuki Inohara, Okazaki (JP)

(73) Assignees: Nippon Soken, Inc. (JP); Denso Corporation (JP)

( * ) Notice: Subject to any disclaimer, the term of this patent is extended or adjusted under 35 U.S.C. 154(b) by 0 days.

(21) Appl. No.: 10/419,272

(22) Filed: Apr. 21, 2003

(65) Prior Publication Data

US 2003/0226532 A1 Dec. 11, 2003

(30) Foreign Application Priority Data

Apr. 19, 2002 (JP) ..... 2002-117885
Oct. 31, 2002 (JP) ..... 2002-318793

(51) Int. Cl.[7] ..... F01L 1/34

(52) U.S. Cl. ..... 123/90.15; 123/90.11; 123/90.17

(58) Field of Search ..... 123/90.11, 90.15, 123/90.17, 90.16, 90.18, 90.27, 90.31; 251/129.01, 129.04

(56) References Cited

U.S. PATENT DOCUMENTS 4,305,352 A * 12/1981 Oshima et al. ..... 123/90.15
4,463,712 A * 8/1984 Stojek et al. ..... 123/90.17
4,976,229 A * 12/1990 Charles ..... 123/90.17
4,986,801 A * 1/1991 Ohlendorf et al. ..... 475/331
5,209,194 A * 5/1993 Adachi et al. ..... 123/90.17
6,138,622 A * 10/2000 Heer ..... 123/90.17
2002/0100444 A1 8/2002 Todo et al.
2002/0100446 A1 8/2002 Watanabe

FOREIGN PATENT DOCUMENTS

JP 4-105906 9/1992
JP 2001-041013 2/2001
JP 2002-227616 8/2002

* cited by examiner

*Primary Examiner*—Thomas Denion
*Assistant Examiner*—Ching Chang
(74) *Attorney, Agent, or Firm*—Nixon & Vanderhye PC

(57) ABSTRACT

A valve timing adjusting device adjusts valve timing by shifting rotational phase of a camshaft relative to a crankshaft. The device has an electric motor for rotating a rotor member that drives and moves a phase defining member to a required position. The phase defining member defines the rotational phase of the camshaft in accordance with the position itself. The phase defining member may be a planetary gear rotatably supported on an eccentric shaft as the rotor member. The planetary gear works as both a reduction mechanism and a phase shifting mechanism. The phase defining member may be a control pin slidably supported on a rotatable member as the rotor member. A planetary gear may be additionally used as the reduction mechanism for rotating the rotatable member. It is possible to control the phase with high accuracy and durability.

23 Claims, 20 Drawing Sheets

VALVE TIMING ADJUSTING DEVICE

CROSS REFERENCE TO RELATED APPLICATIONS

This application is based on Japanese Patent Applications No. 2002-117885 filed on Apr. 19, 2002 and No. 2002-318793 filed on Oct. 31, 2002 the contents of which are incorporated herein by reference.

BACKGROUND OF THE INVENTION

1. Field of the Invention

The present invention relates to a valve timing adjusting device for an internal combustion engine for adjusting an opening and closing timing of at least one of intake and exhaust valves. Hereinafter the internal combustion engine is referred to as an engine. The opening timing and the closing timing of at least one of the valves are referred to as valve timing.

2. Description of Related Art

A valve timing adjusting device is known that is provided in a transmission system for transferring a driving torque of a crankshaft as an engine drive shaft to a camshaft as a driven shaft, and permits of adjustment of the camshaft functioning to open and close intake or exhaust valves in an engine. This valve timing adjusting device changes a rotational phase of the camshaft relative to the crankshaft to thereby adjust the valve timing for improving the engine output or the fuel economy. The rotational phase of the camshaft is referred to as a phase.

Another valve timing adjusting device is known that changes the phase of a camshaft relative to a crankshaft using an oil pressure. The device, however, has a problem where in controlling a phase change with high accuracy, it demands a certain stable condition need for controlling an oil pressure even when in an environment of low temperature or just after start-up of an engine.

Still another valve timing adjusting device that allows the phase of a camshaft relative to a crankshaft to be changed using not an oil pressure but an electric motor is disclosed in JP-U-4-105906 that is an application publication for the utility model registration. This device is designed such that torque is applied to a rotary shaft by an electric field caused by an electromagnetic unit in an electric motor and then the torque on the rotary shaft is transmitted to a camshaft for inducing a phase change.

The device of the patent literature 1 also has following problems. The whole of the electric motor rotates together with a sprocket which receives the driving torque from the crankshaft, causing an inertia weight on the device to becomes large. This leads to deterioration of the durability of the device. Beside, energizing the electromagnetic unit of the electric motor which is rotating needs a slide-contact connection member such as brush which electrically connects a terminal in the electromagnetic unit and a terminal of wiring with each other by slide contact, the wiring being for the supply of an electric current to the electromagnetic unit. Such a slide-contact connection member is apt to wear, bringing about low durability and radio noise.

SUMMARY OF THE INVENTION

It is an object of the present invention to provide a valve timing adjusting device superior in durability.

It is another object of the present invention to provide a valve timing adjusting device capable of controlling a phase change of a driven shaft relative to a drive shaft constantly with high accuracy and superior in durability.

According to a first aspect of the present invention, when an electromagnetic unit generates a magnetic field along an outer periphery of an operating shaft and a first torque acting in a direction opposite to a rotational direction is imparted to the operating shaft, the operating shaft and an eccentric shaft connected to the operating shaft rotate relatively in a delay direction with respect to a rotatable member. This allows a planetary gear to rotate relatively in an advance direction with respect to the rotatable member together with an output shaft engaged with the planetary gear and a driven shaft connected to the output shaft while rotating relatively in an advance direction with respect to the eccentric shaft; which planetary gear being supported relatively rotatably by an outer periphery wall of the eccentric shaft eccentric to a driven shaft axis, engaging an internal gear in the rotatable member and adapted to rotate about the driven shaft axis. Therefore, when the first torque is applied to the operating shaft, the phase of the driven shaft relative to the rotatable member, i.e., the phase of the driven shaft relative to a drive shaft which allows the rotatable member to rotate with a driving torque, can be changed to an advance side.

When the electromagnetic unit generates a magnetic field along the outer periphery of the operating shaft and a second torque acting in the rotational direction is imparted to the operating shaft, the operating shaft and the eccentric shaft rotate relatively in an advance direction with respect to the rotatable member. This allows the planetary gear to rotate relatively in a delay direction together with the output shaft and the driven shaft with respect to the rotatable member while rotating relatively in a delay direction with respect to the eccentric shaft. Therefore, when the second torque is imparted to the operating shaft, the phase of the driven shaft relative to the rotatable member, i.e., the phase of the driven shaft relative to the drive shaft, can be changed to a delay side.

Since a magnetic field that resists against such working conditions as an environmental temperature and the time elapsed from the start of operation is generated and is applied to change the phase, it is possible to change the phase with high accuracy.

The electromagnetic unit for imparting to the operating shaft the first and second torques which induce a phase change of the driven shaft relative to the drive shaft is fixed to an engine so as not to be displaced. Consequently, an inertia weight imposed on the device can be made small and hence the durability of the device is improved. Moreover, electrical connection of wiring for the supply of an electric current to the electromagnetic unit to the electromagnetic unit fixed to the engine eliminates a slide-contact connection member such as brush from that connection. This can solve a problem of the conventional device that the durability is deteriorated due to wear of the slide-contact connection member.

According to another aspect of the present invention, the operating shaft, the electromagnetic unit which supports the operating shaft rotatably, and a current-supply control unit which controls the supply of an electric current to the electromagnetic unit and is bonded to the electromagnetic unit, constitute an electric motor. Thus, the operating shaft, the electromagnetic unit and the current-supply control unit can be replaced easily as a single electric motor, improving the maintainability.

According to another aspect of the present invention, the same device is further provided with a sensor unit for detecting a rotational angle of the operating shaft, and in accordance with the rotational angle detected by the sensor unit, the current-supply control unit controls the supply of an electric current to the electromagnetic unit. Thus, a phase change of the driven shaft relative to the drive shaft can be controlled with higher accuracy.

According to another aspect of the present invention, an outer periphery of the operating shaft has a magnet which forms a magnetic pole, so that larger first and second torques can be imparted to the operating shaft within the magnetic field generated by the electromagnetic unit. This can diminish energy which is consumed by the supply of an electric current to the electromagnetic unit.

According to another aspect of the present invention, the magnet is constituted by a rare earth magnet. Consequently, even if an external shape of the magnet constituted by a rare earth magnet is small-sized, it is possible to form a strong magnetic pole and obtain larger first and second torques, so that the size of the device can be reduced.

According to another aspect of the present invention, the device is further provided with a friction member that enhances a frictional force between the rotatable member and at least one of the planetary gear and the output shaft both adapted to rotate relatively with respect to the rotatable member. According to this construction, even if a torque for rotating the planetary gear and the output shaft relatively with respect to the rotatable member is generated by a sudden change of engine torque which is transmitted through the driven shaft, the generated torque can be diminished by the frictional force of the friction member. Thus, even in the event of a sudden change of engine torque, the planetary gear and the output shaft can be rotated relatively with respect to the rotatable member at normal angles proportional to the first and second torques, so that a desired phase change can be realized for the driven shaft.

According to another aspect of the present invention, the output shaft has at least one engaging hole of a circular section around the driven shaft axis, and the planetary gear has at least one engaging lug of a circular section around the eccentric shaft axis for insertion into the corresponding engaging hole from an opening of the hole. Upon mutual engagement of inner and outer peripheral walls of corresponding engaging hole and engaging lug respectively, the output shaft comes into engagement with the planetary gear. With such a relatively simple construction, it is possible to attain the engagement of the output shaft with the planetary gear.

According to another aspect of the present invention, an inner periphery wall of the engaging hole is tapered so as to be larger in diameter toward the opening side of the engaging hole into which the engaging lug is inserted, while an outer periphery wall of the engaging lug is tapered so as to be smaller in diameter toward the tip of the lug. Further, the engaging lug is provided in the planetary gear so as to be movable to both sides in a central axis direction of the lug and is urged in the direction of its insertion into the engaging hole by an urging means. Consequently, the outer periphery wall of the engaging lug is brought into pressure contact with the inner periphery wall of the engaging hole, whereby the transfer of torque from the planetary gear to the output shaft can be prevented from being obstructed by backlash between the engaging lug and the engaging hole.

According to another aspect of the present invention, an electromagnetic unit which imparts a torque to an operating shaft is fixed to an engine so as not to be displaced; which torque being transmitted to an input shaft of a phase changing means to induce a phase change of a drive shaft relative to a drive shaft. Therefore, an inertia weight imposed on the device can be made small and hence the durability of the device is improved. Besides, wiring for the supply of an electric current to the electromagnetic unit is electrically connected to the electromagnetic unit fixed to the engine, so it is not necessary that a slide-contact connection member such as brush be provided in that connection. Accordingly, it is possible to eliminate the conventional device problem that the durability is deteriorated due to wear of the slide-contact connection member.

According to another aspect of the present invention, the operating shaft and the electromagnetic unit constitute an electric motor, which motor can be attached to and detached from the other components of the valve timing adjusting device, thus permitting the operating shaft and the electromagnetic unit to be replaced easily as a single electric motor, whereby the maintainability is improved.

According to another aspect of the present invention, the operating shaft and an input shaft are connected together through a shaft coupling. Consequently, the transfer of torque from the operating shaft to the input shaft can be ensured while making the mounting and removal of the electric motor possible.

According to another aspect of the present invention, the operating shaft and the input shaft are connected with each other through an annular member entrained on both shafts. Consequently, the transfer of torque from the operating shaft to the input shaft can be ensured while making the mounting and removal of the electric motor possible.

According to another aspect of the present invention, the operating shaft and the input shaft are connected with each other by meshing of gears provided in the two respectively. Consequently, the transfer of torque from the operating shaft to the input shaft can be ensured while making the mounting and removal of the electric motor possible.

According to another aspect of the present invention, the phase changing means has a reduction mechanism for decreasing the rotational speed of the input shaft. With the reduction mechanism, it is possible to increase the torque transferred from the operating shaft to the input shaft and hence the torque applied to the operating shaft can be made small by the electromagnetic unit, with consequent reduction in size of the electric motor. This permits improvement of the working efficiency in the motor replacing work.

According to another aspect of the present invention, since components of the reduction mechanism are incapable of displacement in the axial direction of the input shaft, the disposition of the reduction mechanism makes it possible to prevent the device from extending in the axial direction of the input shaft.

According to another aspect of the present invention, the current-supply control unit is accommodated in a case which is bonded to an electromagnetic unit receiving housing so as to permit a current of air generated by rotation of the operating shaft to be introduced into the interior of the case. With this construction, the current-supply control unit located within the case can be cooled by utilizing the current of air generated by rotation of the operating shaft. Therefore, even if the current-supply control unit is positioned adjacent the electromagnetic unit which is apt to produce heat, it is possible to malfunctioning of the current-supply control unit.

According to another aspect of the present invention, the case has an inlet passage and an outlet passage on upper and lower sides, respectively, in the vertical direction to thereby introduce a current of air generated by rotation of the input shaft into the interior of the case through the inlet passage and conduct it to the exterior through the output passage. With this construction, the cooling efficiency for the current-supply control unit can be enhanced; besides, even in the event of liquid entry into the case through the inlet passage, the liquid can be discharged from the lower output passage through the inlet passage.

According to another aspect of the present invention, the outlet passage forms at least one bent portion and therefore the entry of liquid into the case from the outlet passage can be prevented.

Under the condition where the phase changing means adopts a construction in which an engine torque transferred from the driven shaft to a driven-side rotor is difficult to be transferred to the input shaft, when the engine torque changes suddenly, the input shaft does not rotate with that engine torque, but rotates with the torque on the operating shaft which tends to continue rotation by inertia. This causes phase of the driven shaft relative to the drive shaft to be changed.

According to another aspect of the present invention, when the engine torque changes suddenly, it is possible to prevent rotation of the input shaft which is caused by the inertia of the operating shaft; because a transfer member in the phase changing means is used for the transfer of torque between the input shaft and the driven-side rotor, and a friction member in the phase changing means enhances or produces friction between the transfer member or the input shaft and a drive-side rotor. Therefore, the phase of the driven shaft relative to the drive shaft can be controlled with high accuracy.

According to another aspect of the present invention, the friction member is constructed by a resilient member which generates a frictional force by resilient deformation, thus simplifying the construction of the friction means.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

FIG. 1 is taken along a line I—I in FIG. 3;

FIG. 12 is taken along a line XII—XII in FIG. 9A;

FIG. 18 is taken along a line XVIII—XVIII in FIG. 9A;

DETAILED DESCRIPTION OF PREFERRED EMBODIMENTS

Figure 1:
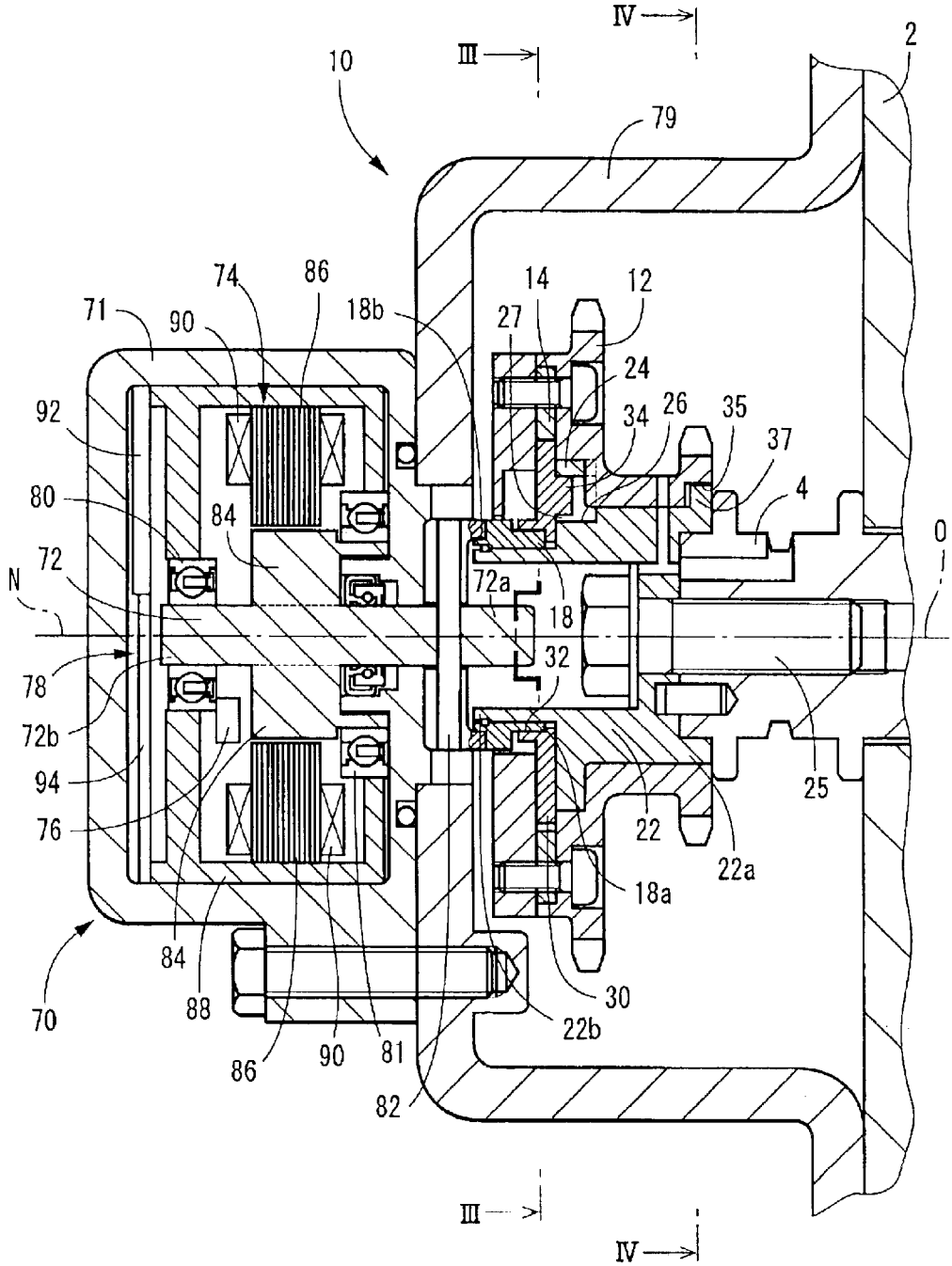
FIG. 1 is a cross sectional view showing a valve timing adjusting device according to a first embodiment of the present invention.
Figure 2:
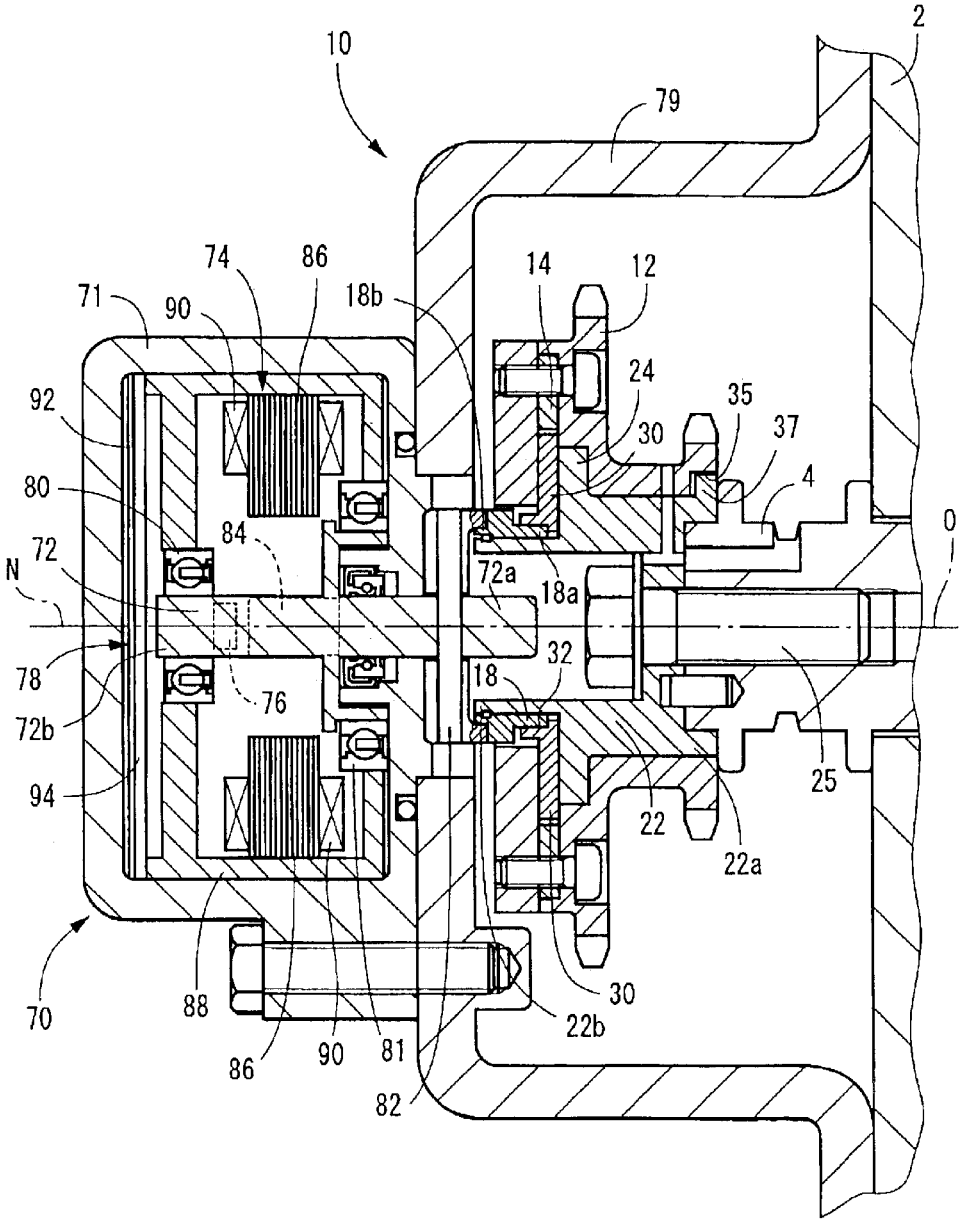
FIG. 2 is a cross sectional view taken along a line II—II in FIG. 3, showing the valve timing adjusting device according to the first embodiment.

Preferred embodiments of the present invention will be described in detail with reference to the accompanying drawings.

First Embodiment

A valve timing adjusting device for an engine according to a first embodiment of the present invention is illustrated in FIGS. 1 to 4. The valve timing adjusting device 10 of this embodiment controls a rotational phase of a camshaft that drives intake valves of an engine 2, thereby it adjusts valve timing of the intake valves.

The valve timing adjusting device 10 is provided in a transmission system which transfers a driving torque on a crankshaft in the engine 2 to a camshaft 4 in the engine. The camshaft 4 is adapted to rotate about its axis O to open and close intake valves in the engine 2. The axis O is referred to as a cam axis. The crankshaft of the engine 2 constitutes a drive shaft and the camshaft 4 constitutes a driven shaft.

A sprocket 12 is supported on an outer periphery wall of an output shaft 22 to be described later in a relatively rotatable manner about the cam axis O. A power transmitting member such as a chain, a gear train or a belt couples the sprocket 12 and the crankshaft. In this embodiment a chain is stretched between and entrained on the sprocket 12 and the crankshaft of the engine 2. The sprocket 12 rotates about the cam axis O when the driving torque on the camshaft is transferred to the sprocket through the chain.

A ring gear 14 is fixed to an inner periphery wall of the sprocket 12. The ring gear 14 is constructed by an internal gear whose tip surface is located on an inner periphery side of its root surface. The ring gear 14 is disposed concentrically with the cam axis O. The ring gear 14 is rotatable together with the sprocket 12 about its central axis, i.e., about the cam axis O. The ring gear 14 constitutes an internal gear and both ring gear 14 and sprocket 12 constitute a rotatable member. Further, the sprocket 12 constitutes a drive-side rotor.

One end portion 22*a* of the output shaft 22 is formed larger in diameter than an opposite end portion 22*b*. One end portion of the camshaft 4 is concentrically fitted in an inner periphery side of the one end portion 22*a*. Further, the output shaft 22 and the camshaft 4 are connected and fixed to each other using a fixing bolt 25.

Consequently, the output shaft 22 is rotatable about the cam axis O integrally with the camshaft 4. The output shaft 22 constitutes a driven-side rotor.

Figure 3:
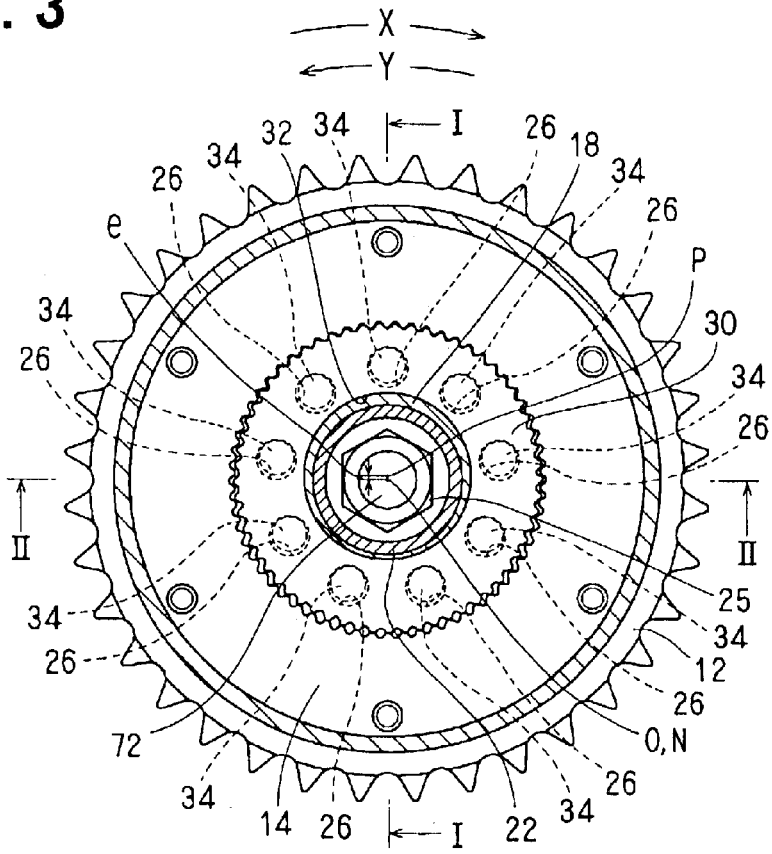
FIG. 3 is a cross sectional view taken along a line III—III in FIG. 1, showing the valve timing adjusting device according to the first embodiment.
Figure 4:
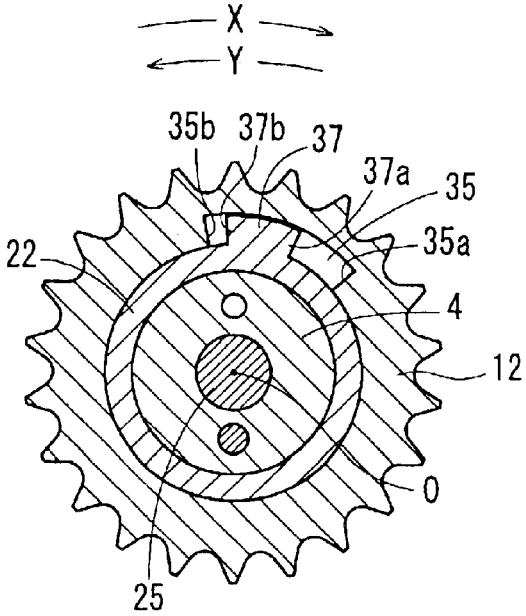
FIG. 4 is a cross sectional view taken along a line IV—IV in FIG. 1, showing the valve timing adjusting device according to the first embodiment.

An eccentric shaft 18 serving as an input shaft is eccentric at its central axis P relative to the cam axis O and is supported on an outer periphery wall of an anti-camshaft-side end portion 22*b* of the output shaft 22 so as to be relatively rotatable about the cam axis O. The axis P of the eccentric shaft 18 is referred to as an eccentric axis P. In FIG. 3, "e" stands for an eccentric quantity of the eccentric axis P with respect to the cam axis O.

A planetary gear 30 is disposed for planetary motion on an outer periphery side of a central portion of the output shaft 22. More specifically, the planetary gear 30 is constructed by an external gear whose tip surface lies on an outer periphery side of its root surface. The radius of curvature of the tip surface of the planetary gear 30 is set smaller than that of the root surface of the ring gear 14 and the number of teeth of the planetary gear 30 is set smaller by one than that of the ring gear 14. In the planetary gear 30 is formed a fitting hole 32 of a circular section. A central axis of the fitting hole 32 is coincident with that of the planetary gear 30. One end portion 18*a* of the eccentric shaft 18 is fitted in the fitting hole 32 through a bearing (not shown), and the planetary gear 30 is supported by an outer periphery wall of the eccentric shaft portion 18*a* so as to be relatively rotatable about an eccentric axis P which is coincident with the axis of the planetary gear. In this supported state a portion of plural teeth of the planetary gear 30 are in mesh with a portion of plural teeth of the ring gear 14.

When a relative rotation of the planetary gear 30 with respect to the eccentric shaft 18 does not occur, the planetary gear 30 rotates about the cam axis O together with the sprocket 12 and the eccentric shaft 18 while being kept in mesh with the ring gear 14 without changing its relative positional relation to the ring gear. During this rotation, if the eccentric shaft 18 rotates relatively in a delay direction Y about the cam axis O with respect to the sprocket 12, the planetary gear 30 which is pressed by an outer periphery wall of the eccentric shaft 18 undergoes the action of the ring gear 14 meshing with the planetary gear and rotates relatively in an advance direction X about the eccentric axis P with respect to the eccentric shaft 18. In this case, the planetary gear 30 rotates relatively in the advance direction X about the cam axis O with respect to the cam sprocket 12 while being partially in mesh with the ring gear 14. On the other, in the case where the eccentric shaft 18 rotates relatively in the advance direction X about the cam axis O with respect to the sprocket 12, the planetary gear 30 which is pressed by the outer periphery wall of the eccentric shaft 18 undergoes the action of the ring gear 14 and rotates relatively in the delay direction Y about the eccentric axis P with respect to the eccentric shaft 18. Further, in this case, the planetary gear 30 rotates relatively in the delay direction Y about the cam axis O with respect to the sprocket 12 while being partially in mesh with the ring gear 14.

Centrally of the output shaft 22 is formed an engaging portion 24 of a disc shape which uses the cam axis O as a rotation symmetry axis. Engaging holes 26 are formed in plural positions of the engaging portion 24. Nine (9) engaging holes 26 are provided. The plural engaging holes 26 are arranged at equal intervals around the cam axis O. Each engaging hole 26 is of a circular section and extends through the engaging portion 24 in the plate thickness direction. One opening 27 of each engaging hole 26 confronts the planetary gear 30. On an outer wall of the planetary gear 30 just in opposition to the engaging portion 24, engaging lugs 34 is integrally formed at plural positions corresponding to the engaging holes 26. The plural engaging lugs 34 are arranged at equal intervals about the eccentric axis P which is eccentric by the eccentric quantity "e" from the cam axis O. Each engaging lug 34 is in the shape of a pin of a circular section projecting toward the engaging portion 24 and is inserted into a corresponding engaging hole 26 from the opening 27 side. In this embodiment, the engaging holes 26 and the engaging lugs 34 extend straight in the direction of the respective central axes. The diameter of each engaging lug 34 is set smaller than that of a corresponding engaging hole 26.

As to the shape of each engaging hole 26, in addition to the both-end opening shape as in this embodiment, there may be adopted a concave shape in which only the planetary gear-side end portion of each engaging hole 26 is open and the anti-planetary gear-side end portion thereof is closed.

While the planetary gear 30 and the sprocket 12 rotate integrally with each other, outer periphery walls of the engaging lugs 34 in the planetary gear 30 are put in engagement with inner periphery walls of corresponding engaging holes 26 and press the engaged inner periphery wall of the engaging holes in the rotational direction (here coincident with the advance direction X). Consequently, the output shaft 22 and the camshaft 4 fixed thereto rotate about the cam axis O while maintaining the phase relation to the sprocket 12 constant. During this rotation, if there occurs a relative rotation of the planetary gear 30 in the advance direction X with respect to the sprocket 12, the engaging lugs 34 further press in the rotational direction the inner periphery walls of engaging holes 26 with which they are engaged. This allows the output shaft 22 and the camshaft 4 to rotate relatively in the advance direction X about the cam axis O with respect to the sprocket 12. On the other hand, if there occurs a relative rotation of the planetary gear 30 in the delay direction Y with respect to the sprocket 12, the engaging lugs 34 press the inner periphery walls of the engaging holes 26 with which they are engaged, in a direction (here coincident with the delay direction Y) opposite to the rotational direction. This allows the output shaft 22 and the camshaft 4 to rotate relatively in the delay direction Y about the cam axis O with respect to the sprocket 12. Thus, in the valve timing adjusting device 10, the engagement of the output shaft 22 with the planetary gear 30 is realized by such a relatively simple construction as engagement of plural engaging lugs 34 with plural engaging holes 26.

A stopper groove 35 is formed in an inner periphery wall of the sprocket 12. The stopper groove 35 extends a predetermined length in an arcuate form centered on the camshaft 4 and is open toward an outer periphery wall of the end portion 22*a* of the output shaft 22. A stopper lug 37 is integrally formed on the outer periphery wall of the output shaft end portion 22*a*. The stopper lug 37 projects into the stopper groove 35 and extends a shorter length than the stopper groove 35 in an arcuate shape centered on the cam axis O.

When the output shaft 22 rotates relatively with respect to the sprocket 12, the stopper lug 37 rotates relatively about the cam axis O within the stopper groove 35. At this time, an advance direction-side end portion 37*a* of the stopper lug 37 comes into abutment against an advance direction-side end portion 35*a* of the stopper groove 35, whereby the relative rotation of the output shaft 22 in the advance direction X is inhibited. This inhibited position is the most advanced position of the output shaft 22. Further, a delay direction-side end portion 37*b* of the stopper lug 37 comes into abutment against a delay direction-side end portion 35*b* of the stopper groove 35, whereby the relative rotation of the output shaft 22 in the delay direction Y is inhibited. This inhibited position is the most delayed position of the output shaft 22. Thus, in this embodiment, a relative rotation range of the output shaft 22 and hence that of the camshaft 4 are delimited by the arcuate lengths of the stopper groove 35 and the stopper lug 37. For example, a large relative rotation range of the camshaft 4 can be ensured by setting the arcuate length of the stopper groove 35 relatively long and that of the stopper lug 37 relatively short.

An electric motor 70 is composed of a housing 71, an operating shaft 72, an electromagnetic unit 74, a sensor unit 76, and a current-supply control unit 78. The housing 71 is bolted to the engine 2 through a stay 79.

Figure 5:
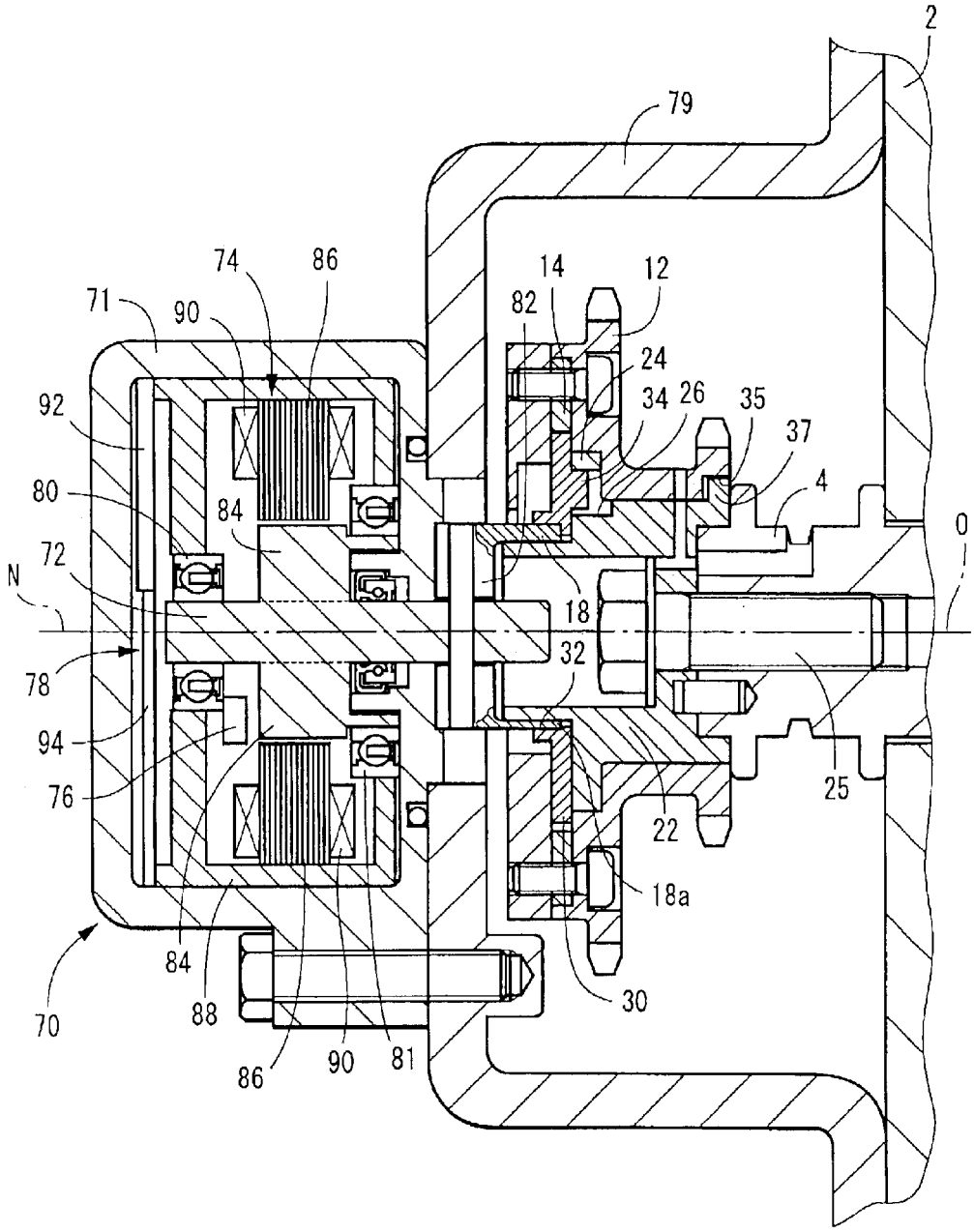
FIG. 5 is a cross sectional view showing a modification of the valve timing adjusting device of the first embodiment.

The operating shaft 72 is supported rotatably about the cam axis O by means of bearings 80 and 81 in the electromagnetic unit 74 which is received and fixed into the housing 71. One end portion 72*a* side of the operating shaft 72 is connected an anti-planetary gear-side end portion 18*b* of the eccentric shaft 18 through an aligning coupling 82. Consequently, the operating shaft 72 is rotatable about the cam axis O integrally with the eccentric shaft 18. The aligning coupling 82 is used to align a central axis N of the operating shaft 72 with the cam axis O at the time of connecting the operating shaft 72 to the eccentric shaft 18. A modification of this embodiment is shown in FIG. 5, in which the aligning coupling 82 and the eccentric shaft 18 are constructed by a single member.

The operating shaft 72 is provided with magnets 84 which project radially outward from an outer peripheral wall of a central portion of the operating shaft, the magnets 84 having magnetic poles at respective projecting tips. In this embodiment, the magnets 84 are each formed by a rare earth magnet and are located at two mutually opposed positions around the cam axis O so that the magnetic poles at the respective projecting tips are different from each other.

The electromagnetic unit 74 is fixed through the housing 71 and stay 79 to the engine 2 so as not to be displaced and is disposed on the outer periphery of the central portion of the operating shaft 72. The electromagnetic unit 74 has a generally cylindrical body 88, plural core portions 86, plural coils 90, and the bearings 80, 81. The plural core portions 86 are provided so as to project toward the outer periphery wall of the operating shaft 72 from equally spaced positions around the cam axis O on an inner periphery wall of the body 88. The plural coils 90 are wound round corresponding core portions 86 respectively. In this embodiment, each core portion 86 is formed by laminating plural iron pieces. In this embodiment, moreover, four sets of core portions 86 and coils 90 are arranged at 90° intervals from one another around the cam axis O. Further, in this embodiment, winding directions of the coils 90 are set so as to be opposite to each other between opposed coils 90 when viewed from projecting tips of the corresponding core portions 86. The electromagnetic unit 74 generates a magnetic field along the outer periphery of the operating shaft 72 in accordance with the supply of an electric current to the coils 90.

The sensor unit 76 is received and fixed into the body 88 of the electromagnetic unit 74 on the outer periphery of the central portion of the operating shaft 72. For example, the sensor unit 76 detects the intensities of the magnetic poles of the magnets 84 in the operating shaft 72, thereby detecting an absolute value of a rotational angle of the operating shaft 72.

The current-supply control unit 78 is accommodated within the housing 71 in the vicinity of an anti-eccentric shaft-side end portion 72*b* of the operating shaft 72 and is bonded and fixed directly to the body 88 of the electromagnetic unit 74. The current-supply control unit 78 has a drive circuit 92 and a control circuit 94. The drive circuit 92 is electrically connected to each coil 90 in the electromagnetic unit 74 to supply the connected coil 90 with an electric current. The control circuit 94 is electrically connected to both drive circuit 92 and sensor unit 76. On the basis of the rotational angle of the operating shaft 72 detected by the sensor unit 76, the control circuit 94 controls the electric current to be fed from the drive circuit 92 to each coil 90.

The current-supply control for the coils 90 by the control circuit 94 is performed in such a manner that with a magnetic field generated by each coil 90, one of a first torque acting in a direction (here coincident with the delay direction Y) opposite to the rotational direction and a second torque acting in the rotational direction (here coincident with the advance direction X) is selected and imparted to the operating shaft 72. More specifically, in this embodiment, alternating currents of the same phase are fed to coils 90 which are opposed to each other, while alternating currents different +90° in phase are fed to coils 90 adjacent to each other, from the drive circuit 92, whereby a rotating magnetic field rotating in a counterclockwise direction (here coincident with the delay direction Y) in FIG. 3 is formed by each coil 90 on the outer periphery of the operating shaft 72. Within the thus-formed magnetic field, the magnets 84 on the operating shaft 72 undergo an attractive force and a repulsive force, whereby the first torque is exerted on the operating shaft 72. The operating shaft 72 with the first torque exerted thereon rotates relatively together with the eccentric shaft 18 in the delay direction Y about the cam axis O with respect to the sprocket 12. In this embodiment, moreover, alternating currents of the same phase are fed to mutually opposed coils 90, while alternating currents different −90° in phase are fed to mutually adjacent coils 90, from the drive circuit 92, whereby a rotating magnetic field rotating in a clockwise direction (here coincident with the advance direction X) in FIG. 3 is formed by each coil 90 on the outer periphery of the operating shaft 72. Within the thus-formed magnetic field, the magnets 84 on the operating shaft 72 undergo an attractive force and a repulsive force, whereby the second torque is exerted on the operating shaft 72. The operating shaft 72 with the second torque exerted thereon rotates together with the eccentric shaft 18 relatively in the advance direction X about the cam axis O with respect to the sprocket 12.

In this embodiment, for imparting the first and second torques to the operating shaft 72, four sets of core portions 86 and coils 90 are arranged around the cam axis O and a rotating magnetic field is formed along the outer periphery of the operating shaft 72 in the manner described above. However, for example, other plural sets than four sets of core portions 86 and coils 90 may be formed around the cam axis O to form a rotating magnetic field along the outer periphery of the operating shaft 72. In this case, an appropriate number of magnets 84 can be determined according to the number of core 86/coil 90 sets. Alternatively, there also may be adopted a construction wherein plural coils 90 arranged at equal intervals about the cam axis O are all wound in the same direction when viewed from the projecting tips of the core portions 86 and are energized one by one successively around the cam axis O, and magnetic fields which the coils 90 form on the outer periphery of the operating shaft 72 in accordance with the energization are successively exerted on the magnets 84 on the operating shaft 72 to afford first and second torques. In this case, the number of magnet 84 can be set to one.

The following description is now provided about the entire operation of the valve timing adjusting device 10.

When the crankshaft of the engine 2 is driven for rotation with the supply of an electric current to each coil 90 from the drive circuit 92 turned OFF by the control circuit 94, the driving torque on the crankshaft is transmitted to the sprocket 12. This allows the sprocket 12 and the ring gear 14 fixed thereto to rotate integrally. The phase of the sprocket 12 relative to the crankshaft is kept constant. At this time, each coil 90 in a de-energized state does not form a rotating magnetic field, so the first and second torques are not applied to the operating shaft 72 and a relative rotation of the operating shaft 72 and the eccentric shaft 18 relative to the sprocket 12 does not occur. As a result, with rotation of the sprocket 12, the planetary gear 30, as well as the eccentric shaft 18 and the operating shaft 72, rotate together with the sprocket 12. This allows the output shaft 22 engaged with the planetary gear 30 and the camshaft 4 to rotate at a constant phase with respect to the sprocket 12.

If the supply of an electric current from the drive circuit 92 to each coil 90 is controlled by the control circuit 94 during the rotation of the sprocket 12, causing a counter-clockwise rotating magnetic field in FIG. 3 to be developed along the outer periphery of the operating shaft 72, the first torque is imparted to the operating shaft 72 and is transferred to the eccentric shaft 18. Thus, the revolutions per minutes (rpm) of the eccentric shaft 18 is changed relative to the rpm of the sprocket 12. Therefore, the eccentric shaft 18 with the first torque exerted thereon rotates relatively in the delay direction Y with respect to the sprocket 12 and decelerates. Upon receipt of this relative rotation of the eccentric shaft 18 in the delay direction Y, the planetary gear 30 rotates relatively in the advance direction X with respective to the sprocket 12 while rotating relatively in the advance direction X with respect to the eccentric shaft 18. As a result, the output shaft 22 and the camshaft 4 rotate relatively in the advance direction X with respect to the sprocket 12 and gain in speed. That is, the phase of the camshaft 4 with respect to the sprocket 12 changes to the advance side and the phase of the camshaft 4 with respect to the crankshaft also changes to the advance side. At this time, the control circuit 94 does feedback control on the value of an electric current to be fed to each coil 90, using the value of a rotational angle of the operating shaft 72 detected by the sensor unit 76. Consequently, the intensity of a rotating magnetic field formed by each energized coil 90 is controlled and so is the magnitude of the first torque to be applied to the operating shaft 72. As a result, the degree of a phase change to the advance side of the camshaft 4 with respect to the crankshaft is controlled. At this time, a relative rotation of the output shaft 22 and the camshaft 4 in the advance direction X is limited by abutment of the stopper lug end portion 37*a* against the stopper groove end portion 35*a*.

On the other hand, during rotation of the sprocket 12, if the supply of an electric current from the drive circuit 92 to each coil 90 is controlled by the control circuit 94, allowing a clockwise rotating magnetic field in FIG. 3 to be developed along the outer periphery of the operating shaft 72, the second torque is imparted to the operating shaft 72 and is transferred to the eccentric shaft 18. Thus, the rpm of the eccentric shaft 18 is changed relative to the rpm of the sprocket 12. Therefore, the eccentric shaft 18 with the second torque exerted thereon rotates relatively in the advance direction X with respect to the sprocket 12 and gains in speed. With this relative rotation of the eccentric shaft 18 in the advance direction X, the planetary gear 30 rotates relatively in the delay direction Y with respect to the sprocket 12 while rotating relatively in the delay direction Y with respect to the eccentric shaft 18. As a result, the output shaft 22 and the camshaft 4 rotate relatively in the delay direction Y with respect to the sprocket 12 and decelerate. That is, the phase of the camshaft 4 relative to the sprocket 12 changes to the delay side and so does the phase of the camshaft 4 relative to the crankshaft. At this time, the control circuit 94 does feedback control on the value of an electric current to be fed to each coil 90, using a rotational angle value of the operating shaft 72 detected by the sensor 76. With this control, the intensity of a rotating magnetic field formed by each coil 90 is controlled and so is the magnitude of the second torque to be imparted to the operating shaft 72, so that the degree of a phase change to the delay side of the camshaft 4 with respect to the crankshaft is controlled. At this time, a relative rotation of the output shaft 22 and the camshaft 4 in the delay direction Y is inhibited by mutual abutment of the stopper lug end portion 37*b* and the stopper groove end portion 35*b*.

Thus, in this embodiment, the ring gear 14, eccentric shaft 18, planetary gear 30, and engaging portion 24 conjointly constitute a phase change means. That is, the phase change means converts the relative rotational motion of the eccentric shaft 18 with respect to the sprocket 12 into a relative rotational motion of the output shaft 22 with respect to the sprocket 12 and thereby changes the phase of the camshaft 4 with respect to the crankshaft.

According to the valve timing adjusting device 10 described above, no matter to which of advance side and delay side the phase of the camshaft 4 is to be changed with respect to the crankshaft, the first and second torques which induce the phase change are generated on the basis of a magnetic field which is formed along the outer periphery of the operating shaft 72 by each coil 90 in the electromagnetic unit 74. The intensity of the magnetic field resists such working conditions as ambient temperature and the time elapsed from the start of operation, so even in a low temperature environment or at the time of start-up of the engine it is possible to precisely control a change in phase of the camshaft 4 relative to the crankshaft.

Besides, according to the valve timing adjusting device 10, since the electromagnetic unit 74 is fixed to the engine 2 so as not to be displaced, an inertia weight imposed on the device 10 can be made smaller than in the conventional device. Consequently, the connections of the components in the device 10 and the components themselves are improved in durability. Moreover, according to the valve timing adjusting device 10, the current-supply control unit 78 in which both control circuit 94 and drive circuit 92 conjointly control the supply of an electric current to the electromagnetic unit 74, is electrically connected to the electromagnetic unit 74 which is fixed to the engine 2, eliminating such a slide-contact connection member as brush in that connection. This can also eliminate not only the problem that such a slide-contact connection member wears and is deteriorated in durability but also the problem of radio noise generated upon sliding contact of the slide-contact connection member with a terminal.

According to the valve timing adjusting device 10, since the control circuit 94 in the current-supply control unit 78 does feedback control on the supply of an electric current to the electromagnetic unit 74 on the basis of a rotational angle of the operating shaft 72 detected by the sensor unit 76, a change in phase of the camshaft 4 relative to the crankshaft can be controlled more precisely.

Further, according to the valve timing adjusting device 10, since the housing 71, operating shaft 72, electromagnetic unit 74, sensor unit 76, and current-supply control unit 78 are constructed as a single electric motor 70, those components 71, 72, 74, 76, and 78 is easily replaced.

A portion or the whole of the sensor unit 76 and current-supply control unit 78 may be excluded from the constructional conditions of the electric motor 70 and be provided separately from the electric motor.

Further, according to the valve timing adjusting device 10, since the magnets 84 for forming magnetic poles are provided on the outer periphery of the operating shaft 72, the magnets 84 undergo relatively large attractive force and repulsive force within the magnetic field formed by each coil 90 in the electromagnetic unit 74. Therefore, larger first and second torques than in the absence of the magnets 84 can be imparted to the operating shaft 72, thus making it possible to diminish the energy required for the supply of an electric current to the electromagnetic unit 74. Particularly in this embodiment, the magnets 84 are constructed by rare earth magnets of a small external shape capable of forming strong magnetic poles, enabling the device size to be reduced while ensuring the first and second torques.

Instead of the magnets 84 there may be provided metallic lugs projecting from the outer periphery wall of the operating shaft 72.

Second Embodiment

Figure 6:
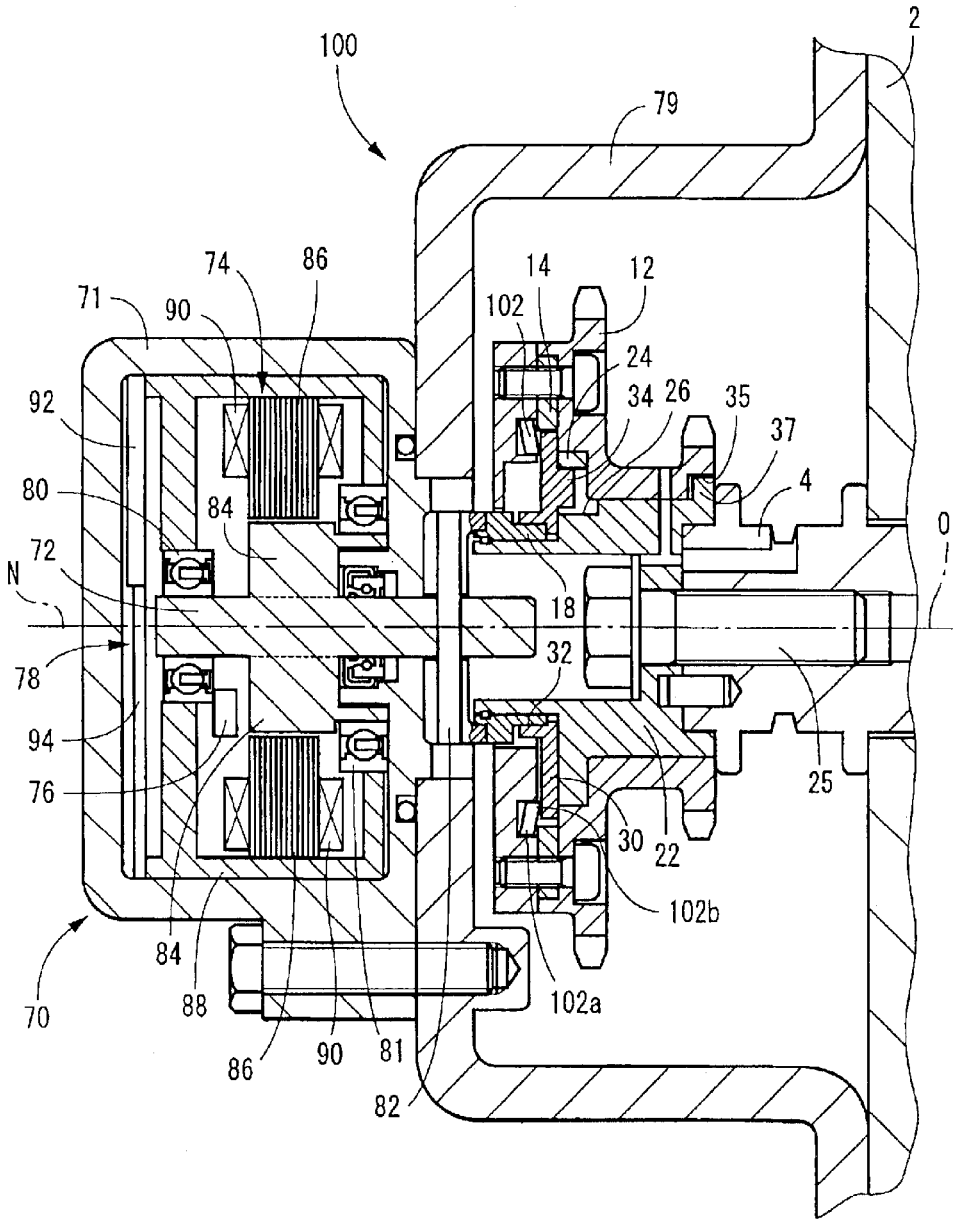
FIG. 6 is a cross sectional view showing a valve timing adjusting device according to a second embodiment of the present invention.

A valve timing adjusting device according to a second embodiment of the present invention is illustrated in FIG. 6, in which substantially the same constituent portions as in the first embodiment are identified by like reference numerals.

In the valve timing adjusting device 100 according to this second embodiment, a coned disk spring 102 as a friction member is interposed between a planetary gear 30 and a sprocket 12. An end portion 102*a* on a large diameter side of the coned disk spring 102 is fixed to the sprocket 12, while an end portion 102*b* on a small diameter side of the coned disk spring 102 is pressed for sliding contact against an outer wall on an anti-engaging portion side of the planetary gear 30. According to this construction, when the planetary gear 30 tries to rotate relatively with respect to the sprocket 12, a frictional force proportional to a resilient characteristic of the coned disk spring 102 is generated in the slide contact portion between the coned disk spring 102 and the planetary gear 30, i.e., between the sprocket 12 and the planetary gear 30.

In the valve timing adjusting device 100 provided with the coned disk spring 102, even if a torque which causes the output shaft 22 and hence the planetary gear 30 to rotate relatively with respect to the sprocket 12 is developed by an abrupt change of an engine torque which is transferred to the device 100 through the camshaft 4, the generated torque can be diminished by the frictional force obtained by the coned disk spring 102. In the valve timing adjusting device 100, however, a current-supply control unit 78, i.e., control circuit 94, controls first and second torques to be applied to an operating shaft 72 so that both torques are applied in respective desired magnitudes correspondingly to the frictional force generated by the coned disk spring 102. Thus, according to the valve timing adjusting device 100, even when the engine torque changes greatly, the planetary gear 30 and output shaft 22 can be accurately rotated relatively only by an angle required for a desired phase change of the camshaft 4.

The friction member is not limited to the coned disk spring 102 described above, but any other friction means may be adopted insofar as it generates a frictional force by sliding contact thereof with at least one of the sprocket 12 and the planetary gear 30. The friction member may be disposed between the output shaft 22 and the sprocket 12, not at the planetary gear 30.

Third Embodiment

Figure 7:
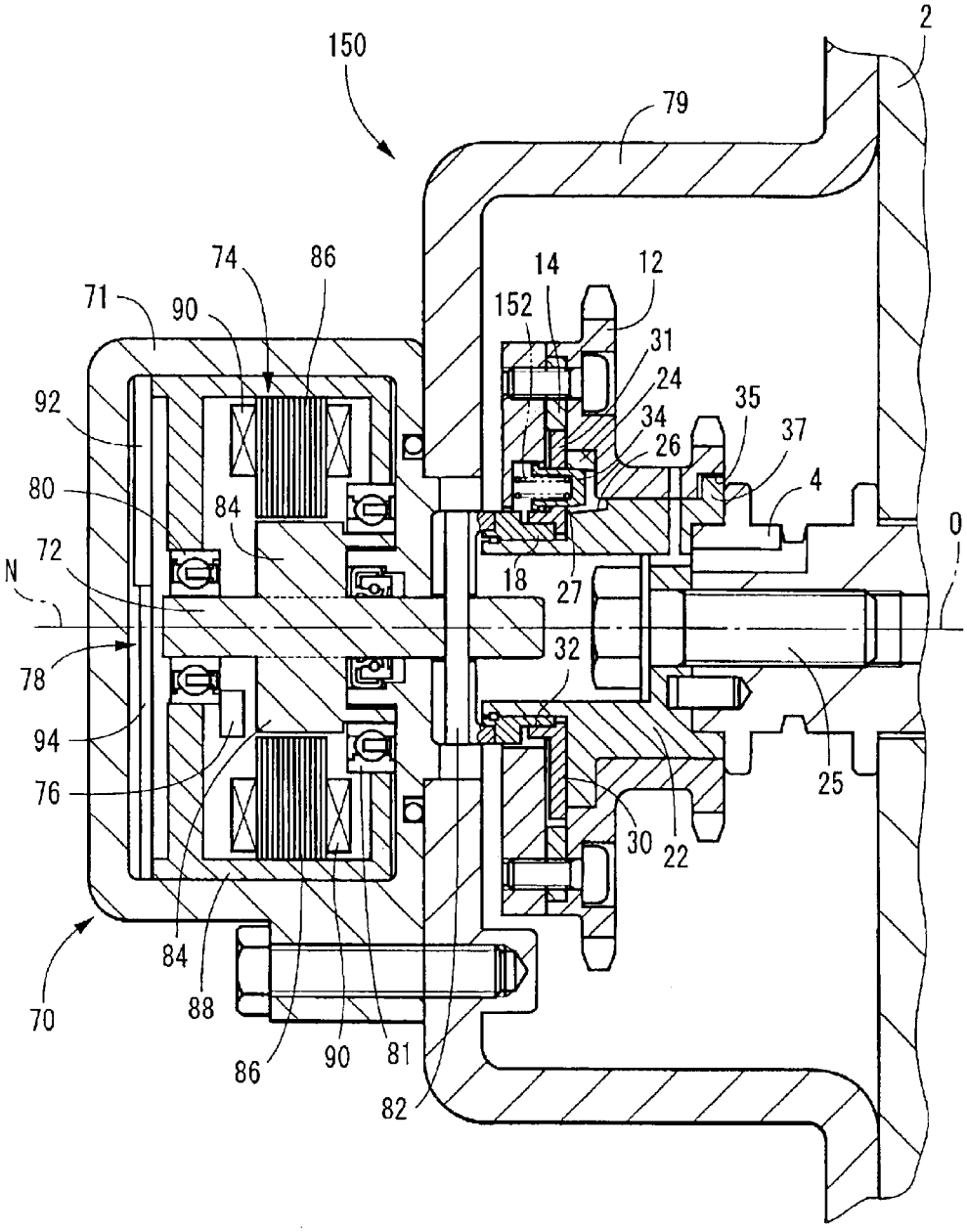
FIG. 7 is a cross sectional view showing a valve timing adjusting device according to a third embodiment of the present invention.
Figure 8:
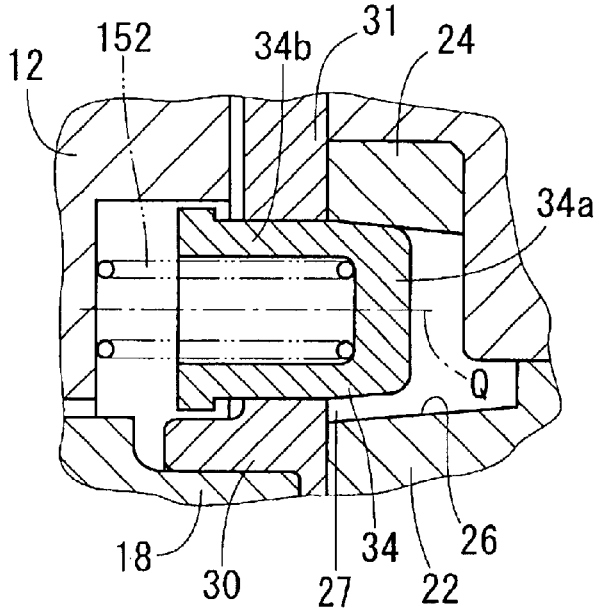
FIG. 8 is an enlarged cross sectional view showing a pin and circumferential components in FIG. 7 according to the third embodiment.

A valve timing adjusting device according to a third embodiment of the present invention is illustrated in FIGS. 7 and 8, in which substantially the same constituent portions as in the first embodiment are identified by like reference numerals.

In the valve timing adjusting device 150 of this third embodiment, an inner periphery wall of each of engaging holes 26 formed in an output shaft 22 is tapered so as to be larger in diameter toward an opening 27 side in which a corresponding engaging lug 34 in the planetary gear 30 is inserted. An outer periphery wall of each engaging lug 34 is tapered so as to be smaller in diameter toward a projecting tip portion 34*a*. Each engaging lug 34 is supported at a base portion 34*b* thereof by a body 31 of a planetary gear 30 so as to be movable to both sides in a central axis Q direction, and is urged in the direction of insertion into the corresponding engaging hole 26 by means of a coiled spring 152 as an urging means. In this embodiment, as shown in FIG. 8, the diameter of each engaging lug 34 and that of each engaging hole 26 are defined in such a manner that when the outer periphery wall of each engaging lug 34 is brought into abutment with the inner periphery wall of the corresponding engaging hole 26 at a portion including one generation line, the outer periphery wall of the engaging lug 34 exclusive of its portion located near the generation line forms a backlash between it and the inner periphery wall of the engaging hole 26.

In the valve timing adjusting device 100 of such a construction, the outer periphery wall of each engaging lug 34 on undergoing an urging force of the coiled spring 152 is brought into pressure contact with the inner periphery wall of a corresponding engaging hole 26. Thus, the transfer of torque from the planetary gear 30 to the output shaft 22 can be prevented from being obstructed by insufficient pressing force of each engaging lug 34 against the corresponding engaging hole 26 which is caused by the backlash formed between the engaging lug 34 and the engaging hole 26.

Fourth Embodiment

A valve timing adjusting device according to a fourth embodiment of the present invention is illustrated in FIGS. 9 to 19, in which substantially the same constituent portions as in the first embodiment are identified by like reference numerals.

Figure 10:
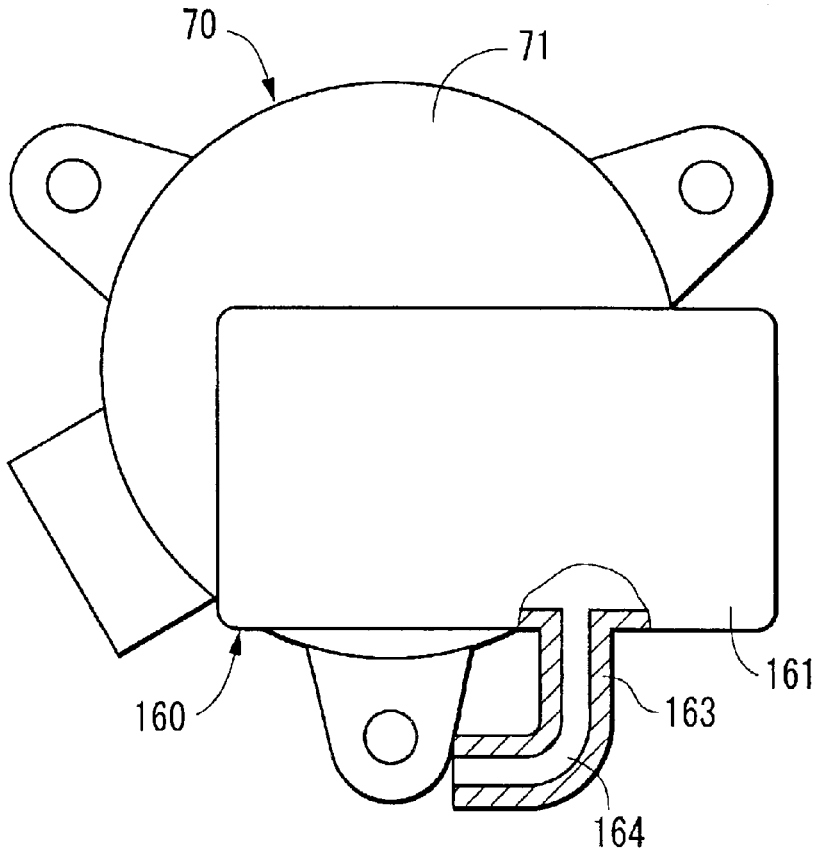
FIG. 10 is a partially cut-away view showing an axial side of the valve timing adjusting device according to the fourth embodiment.
Figure 9A:
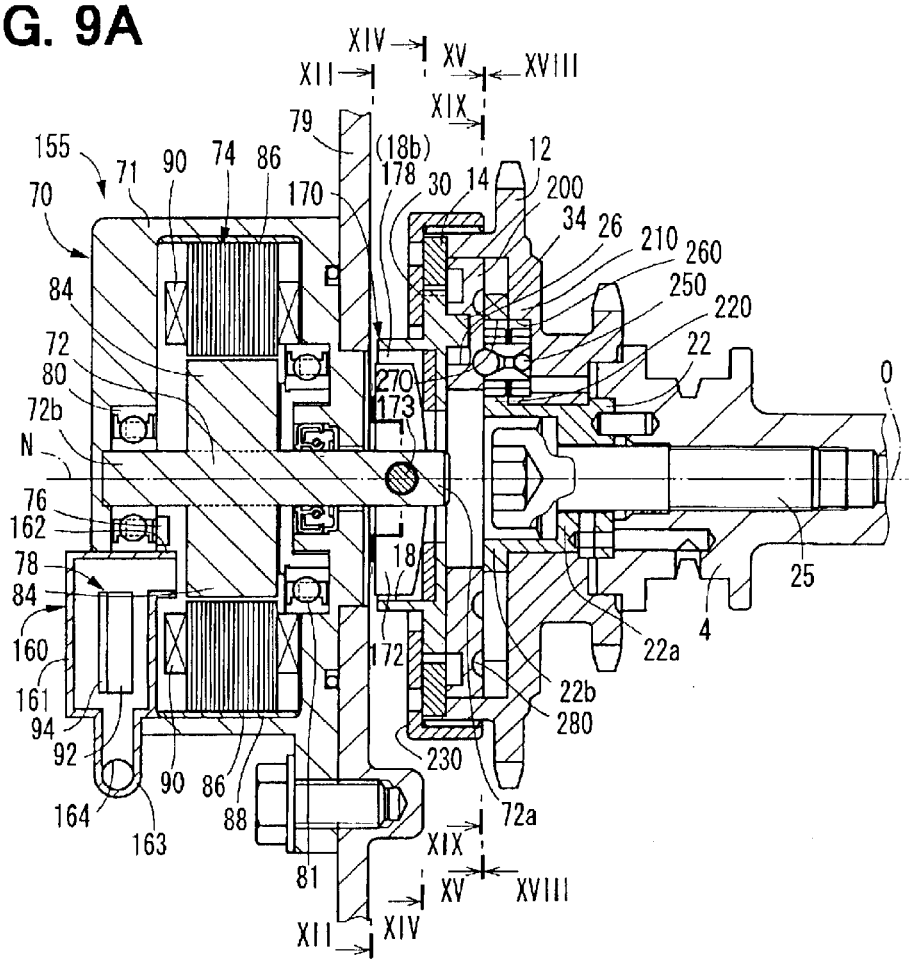
FIG. 9A is a cross sectional view showing a valve timing adjusting device according to a fourth embodiment of the present invention.
Figure 9B:
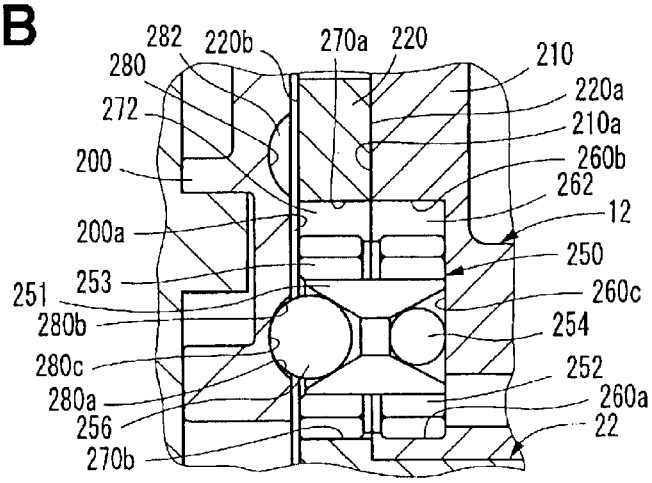
FIG. 9B is an enlarged cross sectional view of a ball and circumferential components in FIG. 9A according to the fourth embodiment.

In an electric motor 70 used in a valve timing adjusting device 155 according to a fourth embodiment of the present invention, as shown in FIGS. 9 and 10, a current-supply control unit 78 is accommodated within a case 160 which is bonded to a housing 71, the housing 71 accommodating an electromagnetic unit 74, etc. therein and being fixed to an engine 2 so as to be incapable of being displacement. The case 160 has an inlet passage 162 and an outlet passage 163 at vertically upper and lower positions respectively in a mounted state of the device 155 to a vehicle. The inlet passage 162 provides communication between the interior of a body 161 of the case 160 and the interior of the housing 71. A housing 71-side opening of the inlet passage 162 is located near an end portion 72*b* of an operating shaft 72, whereby the inlet passage 162 introduces a current of air into the body 161; which air current is created with rotation of the operating shaft 72 and magnets 84. The outlet passage 163 provides communication between the interior of the body 161 of the case 160 and an exterior space around the device 155. The outlet passage 163 is bent in L shape at one position thereof to form a bent portion 164. The current of air introduced into the inlet passage 162 passes through the body 161 of the case 160 and is drawn out to the exterior space from the outlet passage 163.

Thus, since the current of air created with rotation of the operating shaft 72 and the magnets 84 is introduced from the inlet passage 162 into the body 161 of the case 160 and is drawn out from the outlet passage 163, circuits 92 and 94 which constitute the current-supply control unit 78 can be cooled efficiently. Therefore, even if the current-supply control unit 78 is disposed in adjacency to the electromagnetic unit 74 which is apt to generate heat, it is possible to prevent malfunctioning of the current-supply control unit 78. Further, even if liquid should get into the body 161 of the case 160 from the inlet passage 162, the liquid can be discharged from the outlet passage 163 located on a lower side than the inlet passage 162. Besides, the entry of liquid from the outlet passage 163 into the body 161 of the case 160 can be prevented by the bent portion 164.

Figure 11:
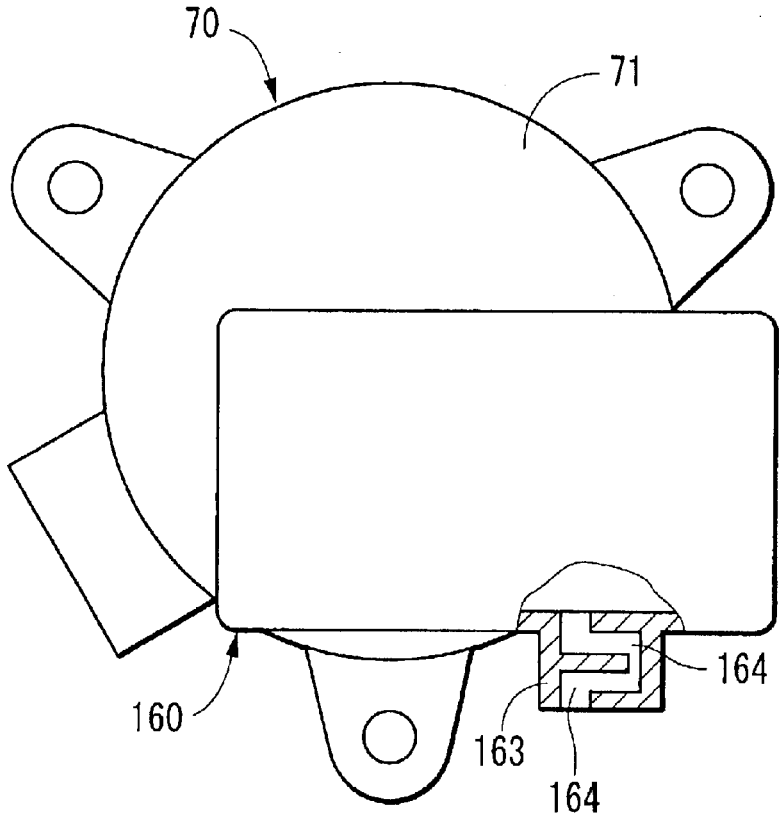
FIG. 11 is a partially cut-away side showing a modification of the valve timing adjusting device according to the fourth embodiment.

As to the outlet passage 163, it may be bent at plural positions in such a labyrinth shape as in FIG. 11 which illustrates a modification, to form plural bent portions 164.

Figure 12:
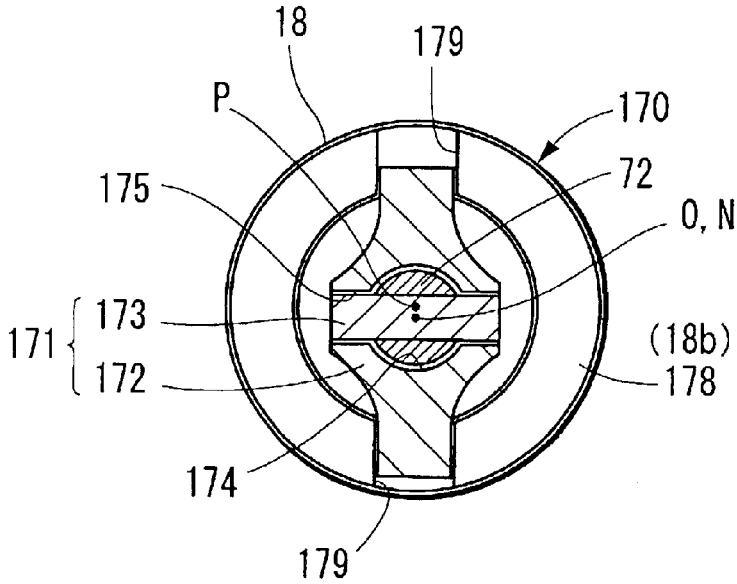
FIG. 12 is a cross sectional view showing a shaft coupling according to the fourth embodiment.
Figure 13:
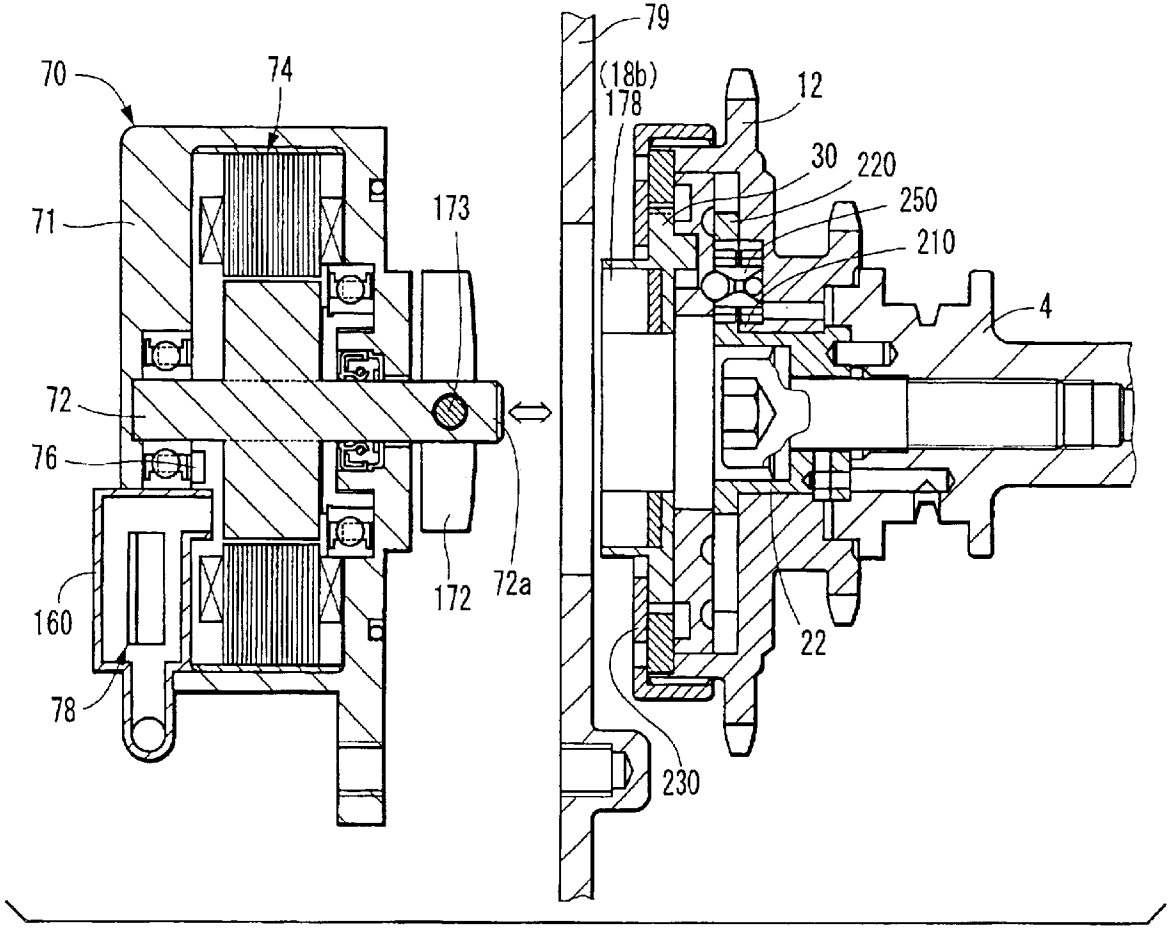
FIG. 13 is an exploded diagram of the valve timing adjusting device according to the fourth embodiment.

In the valve timing adjusting device 155, an end portion 72*a* of the operating shaft 72 is connected for integral rotation to an end portion 18*b* of an eccentric shaft 18 as an input shaft through such a shaft coupling 170 as shown in FIGS. 9 and 12. The shaft coupling 170 has a first fitting portion provided on the operating shaft 72 and a second fitting portion 178 constituted by the end portion 18*b* of the eccentric shaft 18. The operating shaft 72 and the eccentric shaft 18 are connected together by mutual fitting of both fitting portions 171 and 178.

More specifically, the first fitting portion 171 is composed of a connecting member 172 and a guide member 173. The connecting member 172 extends in I shape and a through hole 174 extends perpendicularly through a central part in the extending direction of the connecting member 172. Further, a guide hole 175 is formed through the central part in the extending direction of the connecting member 172; which guide hole 175 extending perpendicularly to an axis in that extending direction and also to an axis in the extending direction of the through hole 174. The guide member 173 is formed in the shape of a pin and is mounted perpendicularly to the operating shaft 72. The operating shaft 72 is passed through the through hole 72, while the guide member 173 is passed through the guide hole 175. Gaps of predetermined sizes are formed respectively between an inner periphery wall of the through hole 174 and an outer periphery wall of the operating shaft 72 and between an inner periphery wall of the guide hole 175 and an outer periphery wall of the guide member 173.

The second fitting portion 178 is cylindrical and has two guide holes 179 extending through the cylindrical wall of the second fitting portion perpendicularly to a central axis P of the second fitting portion, i.e., an eccentric axis P. Each guide hole 179 is open to an anti-planetary gear-side end face of the second fitting portion 178. Both end portions in the extending direction of the connecting member 172 are removably fitted in the guide holes 179 respectively, whereby the operating shaft 72 is disposed in parallel with an inner periphery side of the eccentric shaft 18 including the second fitting portion 178 and is connected to the eccentric shaft 18.

Thus, the transfer of torque is effected positively between the operating shaft 72 and the eccentric shaft 18 which are connected together by the shaft coupling 170. Moreover, since the connecting member in the first fitting portion 171 and the second fitting portion 178 are removably fitted together, the electric motor 70 can be mounted and removed easily with respect to the other components of the valve timing adjusting device 155. This improves the maintainability. Further, a relative position of the operating shaft 72 with respect to the eccentric shaft 18 can be set freely in both a guide direction of the guide member 173 by the guide hole 175 and a guide direction of the connecting member 172 by the guide hole 179, i.e., in two directions perpendicular to the eccentric shaft 18 and perpendicular to each other. Therefore, when installing the electric motor 70, a central axis N of the operating shaft is easily aligned with a cam axis O.

Figure 18:
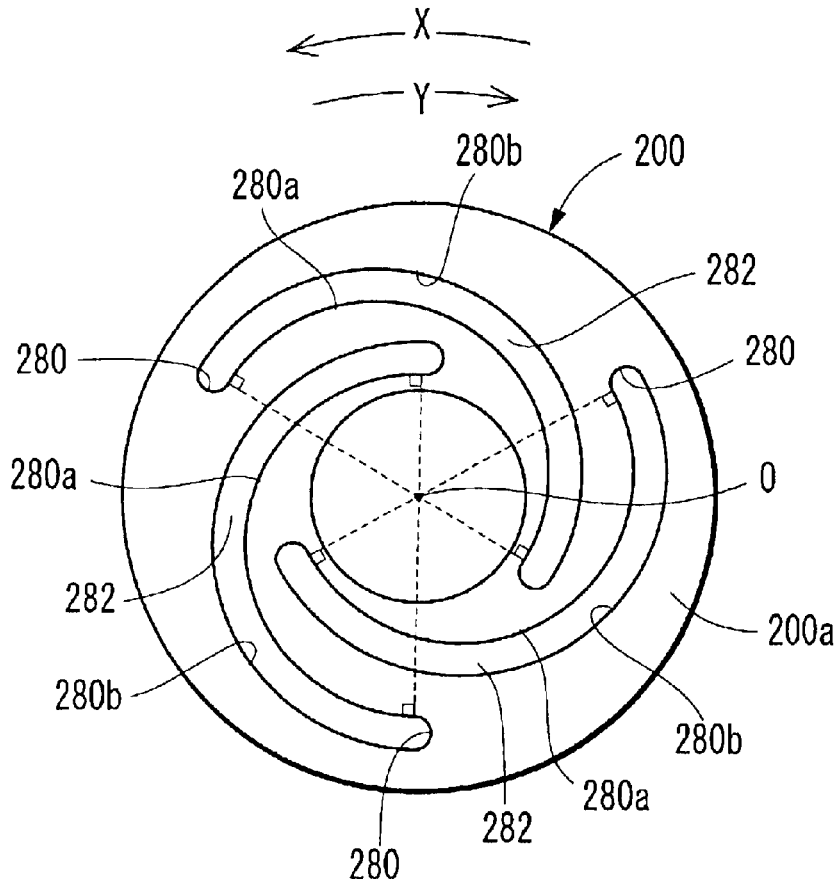
FIG. 18 is a plan view showing a rotatable member used in the valve timing adjusting device according to the fourth embodiment.

In the valve timing adjusting device, as shown in FIG. 9, a portion corresponding to the engaging portion 24 of the output shaft 22 in the first embodiment is formed as a rotatable member 200 separately from the output shaft 22. The rotatable member 200 is formed in such a disc shape as shown in FIG. 18 and is supported by an inner periphery wall of a sprocket 12 so as to be rotatable relatively about the cam axis O.

Figure 14:
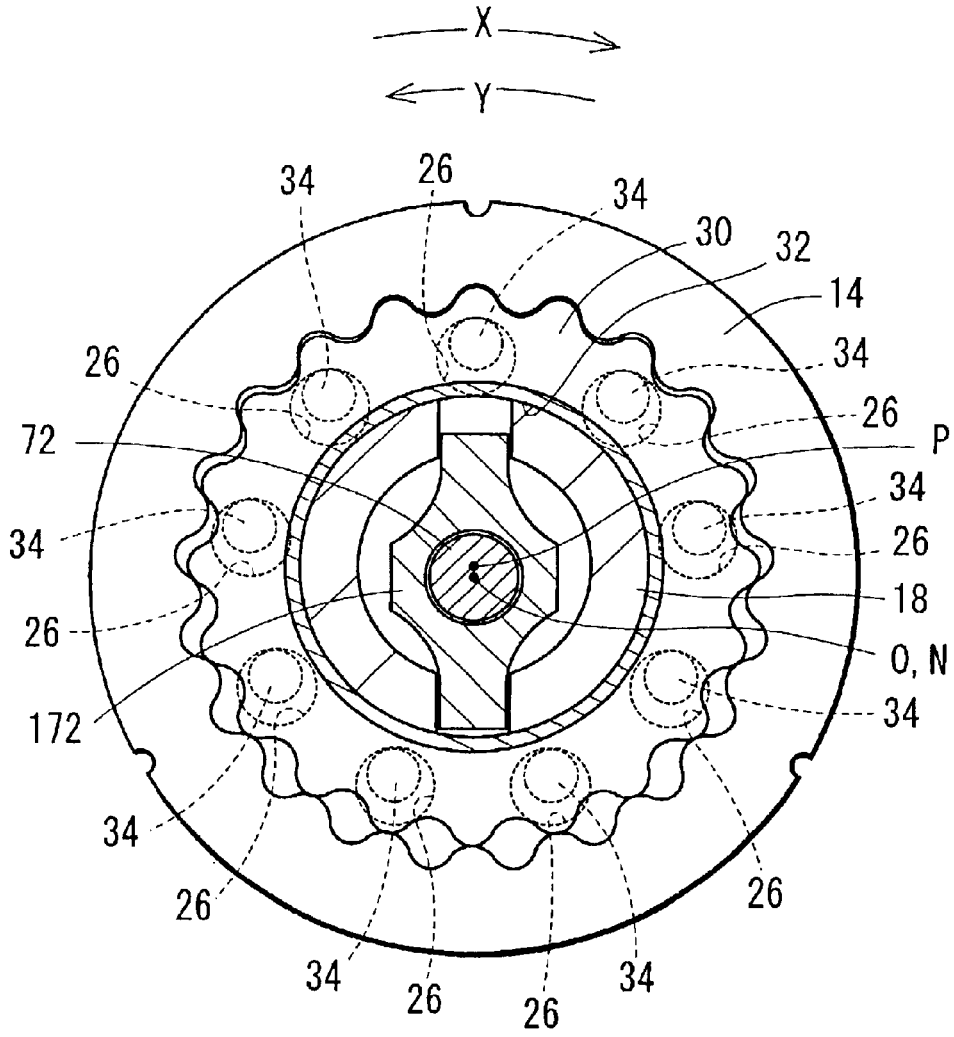
FIG. 14 is a cross sectional view taken along a line XIV—XIV in FIG. 9A according to the fourth embodiment.

When torque is not transferred from the operating shaft 72 of the electric motor 70 to the eccentric shaft 18, a relative rotation of a planetary gear 30 with respect to the eccentric shaft 18 does not occur. Thus, the planetary gear 30 rotates about the cam axis O integrally with the sprocket 12 and the eccentric shaft 18 while meshing with a ring gear 14 without changing a relative positional relation thereof to the ring gear. At this time, the engaging lugs 34 press inner periphery walls of engaging holes 26 in which the lugs are engaged, in the rotational direction, as shown in FIG. 14, so that the rotatable member 200 rotates about the cam axis O while keeping its phase relation to the sprocket 12 constant. If the first torque is transferred from the operating shaft 72 to the eccentric shaft 18 during this rotation, the eccentric shaft 18 rotates relatively in a delay direction Y about the cam axis O with respect to the sprocket 12. This allows the planetary gear 30 which is pressed by an outer periphery wall of the eccentric shaft 18 to undergo the action of the ring gear 14 with which it is engaged, and to rotate relatively in an advance direction X about the eccentric axis P with respect to the eccentric shaft 18. In this case, the planetary gear 30 rotates relatively in the advance direction X about the cam axis O with respect to the sprocket 12 while partially meshing with the ring gear 14. As a result, the first torque which has been increased while changing its direction to the advance direction X is transferred to the rotatable member 200 as the engaging lugs 34 further press the engaging holes 26 in the rotational direction. This allows the rotational member 200 to rotate relatively in the advance direction X with respect to the sprocket 12. On the other hand, when the second torque is transferred from the operating shaft 72 to the eccentric shaft 18, the eccentric shaft 18 rotates relatively in the advance direction X about the cam axis O with respect to the sprocket 12. This allows the planetary gear 30 which is pressed by the outer periphery wall of the eccentric shaft 18 to undergo the action of the ring gear 14 and to rotate relatively in the delay direction Y about the eccentric axis. P with respect to the eccentric shaft 18. In this case, the planetary gear 30 rotates relatively in the delay direction Y about the cam axis O with respect to the sprocket 12 while partially meshing with the ring gear 14. As a result, the second torque which has been increased while changing its direction to the delay direction Y is transferred to the rotatable member 200 as the engaging lugs 34 press the engaging holes 26 in a direction opposite to the rotational direction. This allows the rotatable member 200 to rotate relatively in the delay direction Y with respect to the sprocket 12.

Thus, in this embodiment, the ring gear 14, eccentric shaft 18, planetary gear 30, and rotatable member 200 conjointly constitute a reduction mechanism. In this reduction mechanism, its components 14, 18, 30, and 200 are incapable of displacement in the axis direction of the eccentric shaft 18 and therefore the device 155 does not become long in the axial direction of the eccentric shaft 18. Besides, with this reduction mechanism, the torque transferred from the operating shaft 72 to the eccentric shaft 18 can be increased, diminishing the torque which is imparted to the operating shaft 72 by the electromagnetic unit 74. Consequently, the size of the electric motor 70 can be made small and hence the replacement work efficiency for the electric motor 70 is improved.

Other than the reduction mechanism of the above structure, there also may be used a known reduction mechanism not involving an axial displacement of its components.

Figure 15:
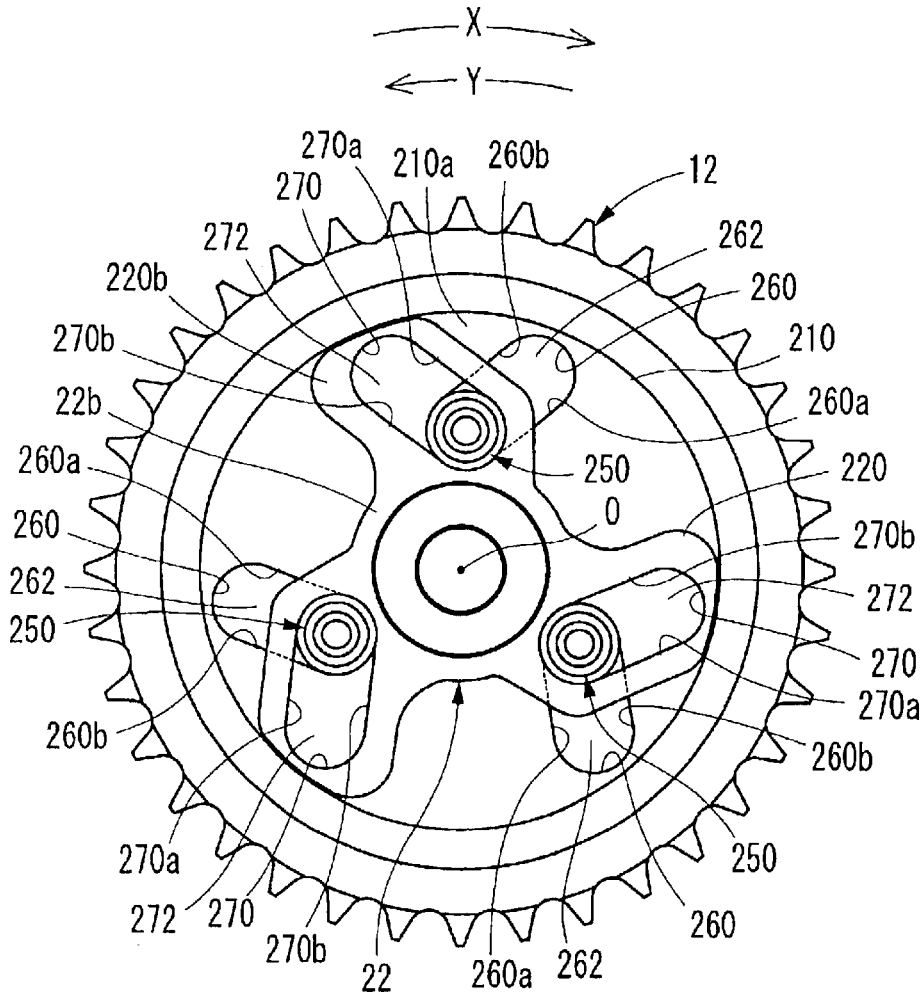
FIG. 15 is a cross sectional view taken along a line XV—XV in FIG. 9A, showing one operating state of the valve timing adjusting device, according to the fourth embodiment.

In the valve timing adjusting device 155, as shown in FIGS. 9 and 15, a disc-shaped converting portion 210, which is perpendicular to the cam axis O, is formed at the center of the sprocket 12. Further, an output shaft 22 of the valve timing adjusting device 155 forms a generally triangular plate-like converting portion 220 which is perpendicular to the cam axis O at an end portion 22*b* located on the side opposite to the camshaft 4. The converting portion 220 is clamped between a cover 230 fixed to the sprocket 12 and the converting portion 210 together with the planetary gear 30 and the rotatable member 200. The converting portion 220 is in abutment against an inner wall 210*a* of the converting portion 210 and is just in opposition to an outer wall 200*a* of the rotatable member 200.

Control pins 250 as control members are connected with the rotatable member 200 and the converting portions 210 and 220. A description will be given below about this connecting structure with reference to FIG. 9 and FIGS. 15 to 19. In FIGS. 15 to 17 and FIG. 19, hatching which represents a section is omitted.

As shown in FIG. 15, holes 260 are formed in three positions of the converting portion 210 so as to overlap one another when they are each rotated 120° about the cam axis O. As shown in FIGS. 9 and 15, each hole 260 is open to an inner wall 210*a* of the converting portion 210 which abuts the converting portion 220. Inner periphery walls of the control pins 260 define tracks 262 for passage therein of the control pins 250 respectively. The track 262 defined by each hole 260 is inclined relative to a radial axis of the converting portion 210 so that a radial distance from the cam axis O changes. In this embodiment, the track 262 defined by each hole 260 extends straight and is inclined in the advance direction X relative to the radial direction with separation from the cam axis O.

In the converting portion 220, as shown in FIG. 15, holes 270 are formed in three positions opposed respectively to the holes 260 in the converting portion 210.

Figure 16:
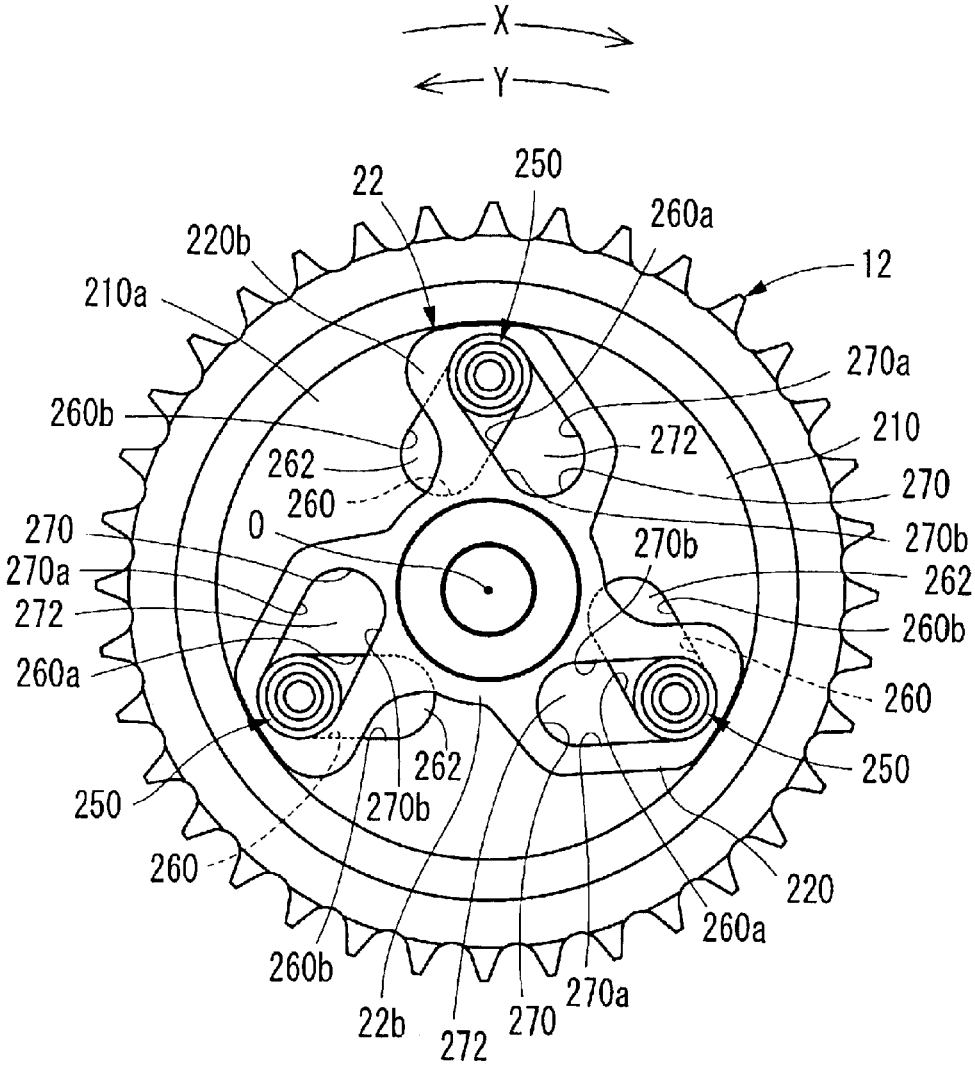
FIG. 16 is a cross sectional view taken along a line XV—XV in FIG. 9A, showing another operating state of the valve timing adjusting device, according to the fourth embodiment.
Figure 17:
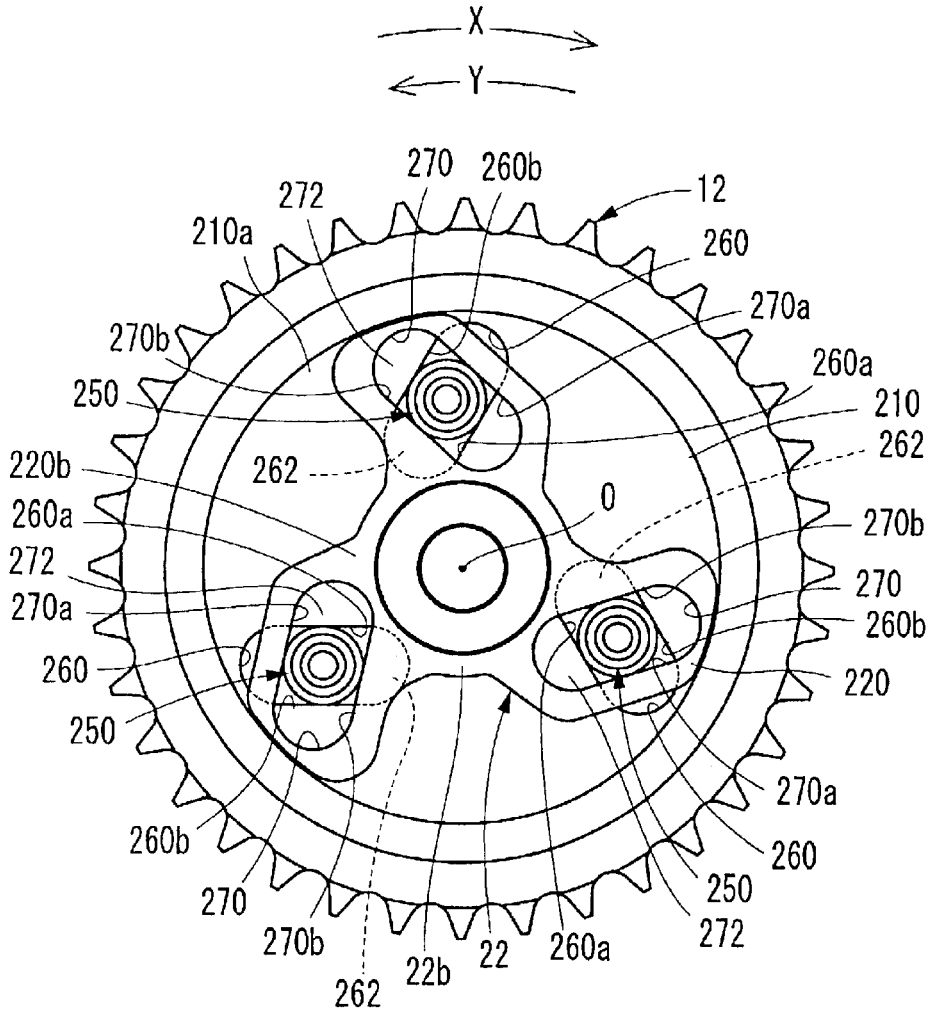
FIG. 17 is a cross sectional view taken along a line XV—XV in FIG. 9A, showing further operating state of the valve timing adjusting device, according to the fourth embodiment.

The holes 270 are formed near three vertexes of the converting portion 220 so as to overlap one another when they are each rotated 120° about the cam axis O. As shown in FIGS. 9 and 15, the holes 270 extend through the converting portion 220 in the plate thickness direction and are open to an outer wall 220*a* of the converting portion 220 abutted against the converting portion 210 and also to an outer wall 220*b* of the converting portion 220 which is just in opposition to the rotatable member 200. Inner periphery walls of the holes 270 define tracks 272 for passage therein of the control pins 250 respectively. The tracks 272 defined by the holes 270 are inclined relative to a radial axis of the converting portion 220 so that a radial distance from the cam axis O changes. In this embodiment, the tracks 272 in the holes 270 extend straight and are inclined in the delay direction Y relative to the radial direction with separation from the cam axis O. Consequently, as shown in FIGS. 15 to 17, the tracks 272 defined by the holes 270 and the tracks 262 defined by the holes 260 and confronting the tracks 272 respectively cross each other at positions corresponding to a rotation phase of the output shaft 22 relative to the sprocket 12.

One of the tracks 262 in the holes 260 and the tracks 272 in the holes 270 need not always be inclined relative to the radial axis. Or the tracks 262 in the holes 260 may be inclined in the delay direction Y with respect to the radial axis with separation from the cam axis O and the tracks 272 in the holes 270 may be inclined in the advance direction X with respect to the radial axis with separation from the cam axis O. Further, the tracks 262 and 272 may each be formed in a curved line shape or in a combined shape of both curved line and straight line.

As shown in FIG. 15, three control pins 250 are provided and are arranged so as to correspond respectively to the three sets of mutually opposed holes 260 and 270.

As shown in FIG. 9, the control pins 250 are each a cylindrical pin extending in parallel with the cam axis O and are held grippingly between the converting portion 210 and the rotatable member 200 so as to pass the intersections of the tracks 262 and 272 formed in the corresponding holes 260 and 270. As shown in FIG. 9 and FIGS. 15 to 17, the holes 260 are abutted against the control pins 250 within the tracks 262 at respective side walls 260*a* and 260*b* of their inner periphery walls which side walls are located on both sides in the rotational direction. Likewise, the holes 270 are abutted against the control pins 250 within the tracks 272 at respective side walls 270*a* and 270*b* of their inner periphery walls which side walls are located on both sides in the rotational direction. Each control pin 250 has a rolling element 252 at the position of its abutment against the corresponding hole 260 and has a rolling element 253 at the position of its abutment against the hole 270. Further, each control pin 250 is provided at one end thereof with a ball element 254 which is abutted against a bottom wall 260*c* of the corresponding hole 260.

Figure 19:
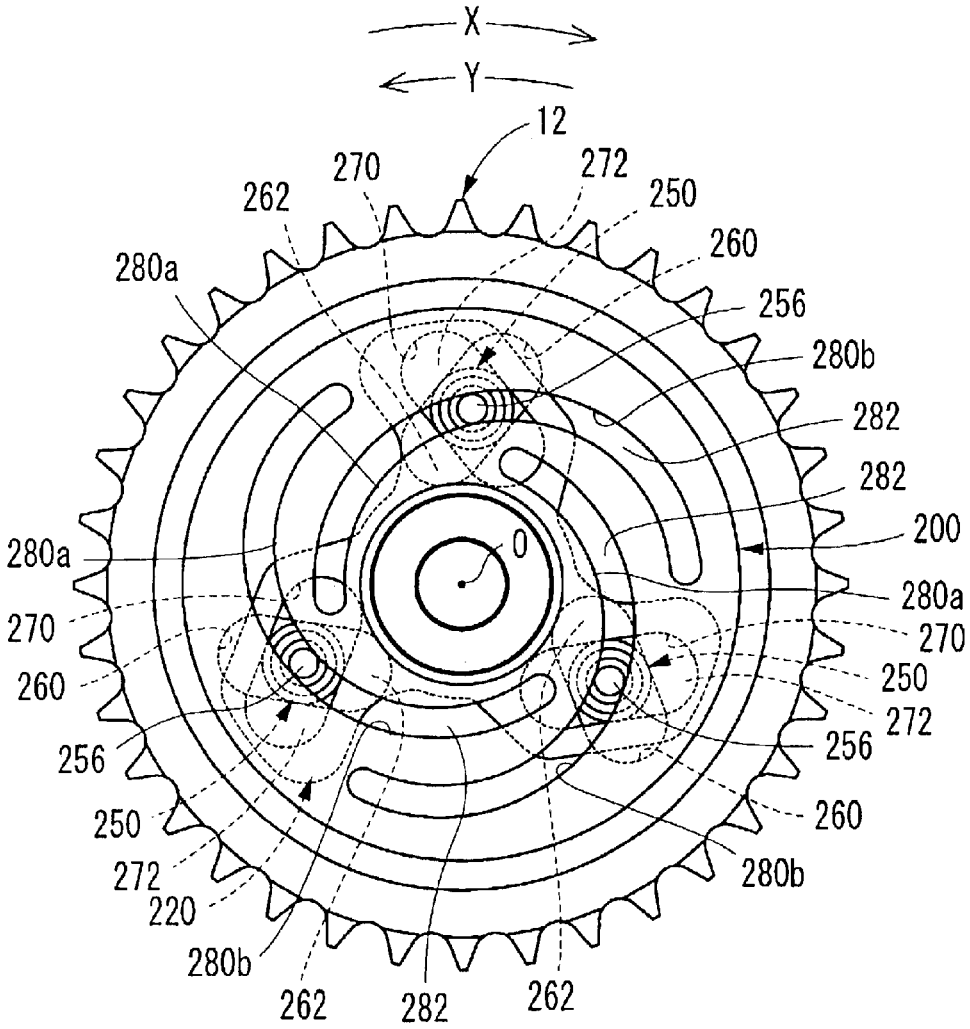
FIG. 19 is a cross sectional view taken along a line XIX—XIX in FIG. 9A according to the fourth embodiment.

As shown in FIGS. 18 and 19, holes 280 are formed in three positions of the rotatable member 200. The holes 280 are formed so as to overlap one another when they are each rotated 120° about the cam axis O. The holes 280 are open to the outer wall 200*a* of the rotatable member 200 which is just in opposition to the converting portion 220. Inner periphery walls of the holes 280 define tracks 282 for passage therein of the control pins 250. The tracks 282 formed in the holes 280 are inclined relative to the radial axis of the rotatable member 200 so that their radial distance from the cam axis O changes. In this embodiment, the tracks 282 in the holes 280 each extend in the form of an arc which is eccentric to the cam axis O and are inclined in the advance direction X relative to the radial axis with separation from the cam axis O. As shown in FIG. 19, this inclination is set so that the track 282 formed in each hole 280 intersect the tracks 262 and 272 formed in any set of holes 260 and 270. In this embodiment, moreover, both end portions of the track 282 in each hole 280 are generally at right angles to the radial direction of the rotatable member 200, as shown in FIG. 18.

As to the track 282 in each hole 280, it may be inclined in the delay direction Y relative to the radial direction with separation from the cam axis O.

As shown in FIGS. 9 and 19, a ball element 256 provided at an end portion on the side opposite to the ball element 254 of any control pin is passed through the track 282 formed in each hole 280. Each hole 280 is abutted against the ball element 256 of the control pin 250 in the associated track 282 at both side walls 280*a* and 280*b* of its inner periphery wall which side walls are located in the radial direction of the tack 282.

In this embodiment, not only the track 282 in each hole 280 is formed in the shape of an eccentric arc, but also the degree of inclination relative to the radial direction is adjusted with respect to the tracks 262, 272, and 282 formed in the holes 260, 270, and 280. As a result, the engine torque transferred from the camshaft 4 to the output shaft 22 is difficult to be transmitted to the rotatable member 200 and further to the eccentric shaft 18.

As to the tracks 282 in the holes 280, they may be extended spirally or straight. In case of adopting a spiral shape, it is possible to realize a construction wherein the engine torque is difficult to be transmitted to the eccentric shaft 18 as is the case with adopting the foregoing eccentric arc.

When coils 90 are de-energized during rotation of the sprocket 12 with the driving torque, the application of torque to the operating shaft 72 by the electromagnetic unit 74 is not performed and there does not occur a relative rotation o the eccentric shaft 18 and further the rotatable member 200 with respect to the sprocket 12. In this state, each control pin 250 rotates together with the rotatable member 200 without moving through the track 282 formed in the corresponding hole 280. Consequently, each control pin 250 does not move through the tracks 262 and 272 formed in the corresponding holes 260 and 270, but transmits the driving torque inputted to the sprocket 12 to the output shaft 22. As a result, the output shaft 22 rotates together with the camshaft 4 while maintaining its phase relative to the sprocket 12. Thus, the phase of the camshaft 4 with respect to the crankshaft is kept constant.

During rotation of the sprocket 12, if the coils 90 are energized to form a rotating magnetic field in the clockwise direction in FIG. 14 along the outer periphery of the operating shaft 74, the second torque is applied to the operating shaft 72 and is transmitted to the eccentric shaft 18. This allows the eccentric shaft 18 to rotate relatively in the advance direction X with respect to the sprocket 12. With this relative rotation of the eccentric shaft 18, the second torque is increased by the reduction mechanism and is transmitted to the rotatable member 200 while changing its direction to the delay direction Y. This allows the rotatable member 200 to rotate relatively in the delay direction Y with respect to the sprocket 12. As a result, each control pin 250 is pressed by the side wall 280*a* of the inner periphery wall of the corresponding hole 280 which side wall extends radially inwards of the associated track 282. This pressing force causes each control pin 250 to move substantially radially outwards of the rotatable member 200 while passing through the associated track 282 relatively in the advance direction X, whereby increasing a radial distance from the cam axis O; which distance will be referred to as a radial distance. At this time, each control pin 250 presses the side wall 260*b* of the inner periphery wall of the corresponding hole 260 in the delay direction Y which side wall extends on the delay side of the associated track 262, and also presses the side wall 270*a* of the inner periphery wall of the associated hole 270 in the advance direction X which side wall extends on the advance side of the associated track 272. As a result, each control pin 250 passes through both tracks 262 and 272 in the corresponding holes 260 and 270 and the output shaft 22 rotates relatively in the advance direction X with respect to the sprocket 12. That is, the phase of the output shaft 22 with respect to the sprocket 12 shifts to the advance side, sot hat the phase of the camshaft 4 with respect to the crankshaft also shifts to the advance side.

On the other hand, during rotation of the sprocket 12, if the coils 90 are energized to form a rotating magnetic field in the counterclockwise direction in FIG. 14 along the outer periphery of the operating shaft 72, the first torque is applied to the operating shaft 72 and is transmitted to the eccentric shaft 18. This allows the eccentric shaft 18 to rotate relatively in the delay direction Y with respect to the sprocket 12. At this time, the first torque for relative rotation of the eccentric shaft 18 is increased by the reduction mechanism and is transmitted to the rotatable member 200 while changing its direction to the advance direction X. This allows the rotational member 200 to rotate relatively in the advance direction X with respect to the sprocket 12. As a result, each control pin 250 is pressed by the side wall 280*b* of the inner periphery wall of the corresponding hole 280 which side wall extends radially outwards of the associated track 282. With this pressing force, each control pin 250 moves generally radially inwards of the rotatable member 200 while passing through the associated track 282 relatively in the delay direction Y, whereby the radial distance is diminished. At this time, each control pin 250 presses the side wall 260*a* of the inner periphery wall of the corresponding hole 260 in the advance direction X which side wall extends on the advance side of the associated track 262. The control pin 250 also presses the side wall 270*b* of the inner periphery wall of the corresponding hole 270 in the delay direction Y which side wall extends on the delay side of the associated track 272. As a result, the output shaft 22 rotates relatively in the delay direction Y with respect to the sprocket 12 while each control pin 250 passes trough both tracks 262 and 272 formed in the corresponding holes 260 and 270. That is, the phase of the output shaft 22 with respect to the sprocket 12 shifts to the delay side, so that the phase of the camshaft 4 with respect to the crankshaft also shifts to the delay side.

Thus, in this embodiment, the reduction mechanism composed of the components 14, 18, 30, and 200, as well as the converting portions 210, 220 and the control pins 250, conjointly constitute a phase changing means. The phase changing means converts a relative rotational motion of the eccentric shaft 18 with respect to the sprocket 12 into a relative rotational motion of the output shaft 22 with respect to the sprocket 12, thereby changing the phase of the camshaft 4 with respect to the crankshaft.

According to the valve timing adjusting device 155 described above, the electromagnetic unit 74 which imparts a torque to the operating shaft 72 is fixed to the engine 2 so as not to be displaced, the torque being transmitted to the eccentric shaft 18 in the phase changing means and inducing a phase change of the camshaft 4 with respect to the crankshaft. As a result, an inertia weight imposed on the device 155 can be made smaller than in the conventional device and hence the connections of components in the device 155, as well as the components themselves, can be improved in durability. According to the valve timing adjusting device 155, moreover, since the current-supply control unit 78 is electrically connected to the electromagnetic unit 74 which is fixed to the engine 2 so as not to be displaced, the electric connection need not be provided with a slide-contact connection member. This eliminates the problem of deteriorated durability and radio noise encountered in the conventional device.

Further, in the valve timing adjusting device 155, the value of an electric current to be fed to each coil 90 is feedback-controlled in the same manner as in the first embodiment by the control circuit 94 in the current-supply control circuit 7 which is housed within the case 160, so that the degree of a phase change of the camshaft 4 with respect to the crankshaft can be controlled precisely. Besides, according to the valve timing adjusting device 155, as noted earlier, since a malfunction of the current-supply control unit 78 can be prevented by cooling the constituent circuits 92 and 94 of the current-supply control unit 78, a defect in controlling the degree of a phase change is difficult to occur.

Fifth Embodiment

Figure 20:
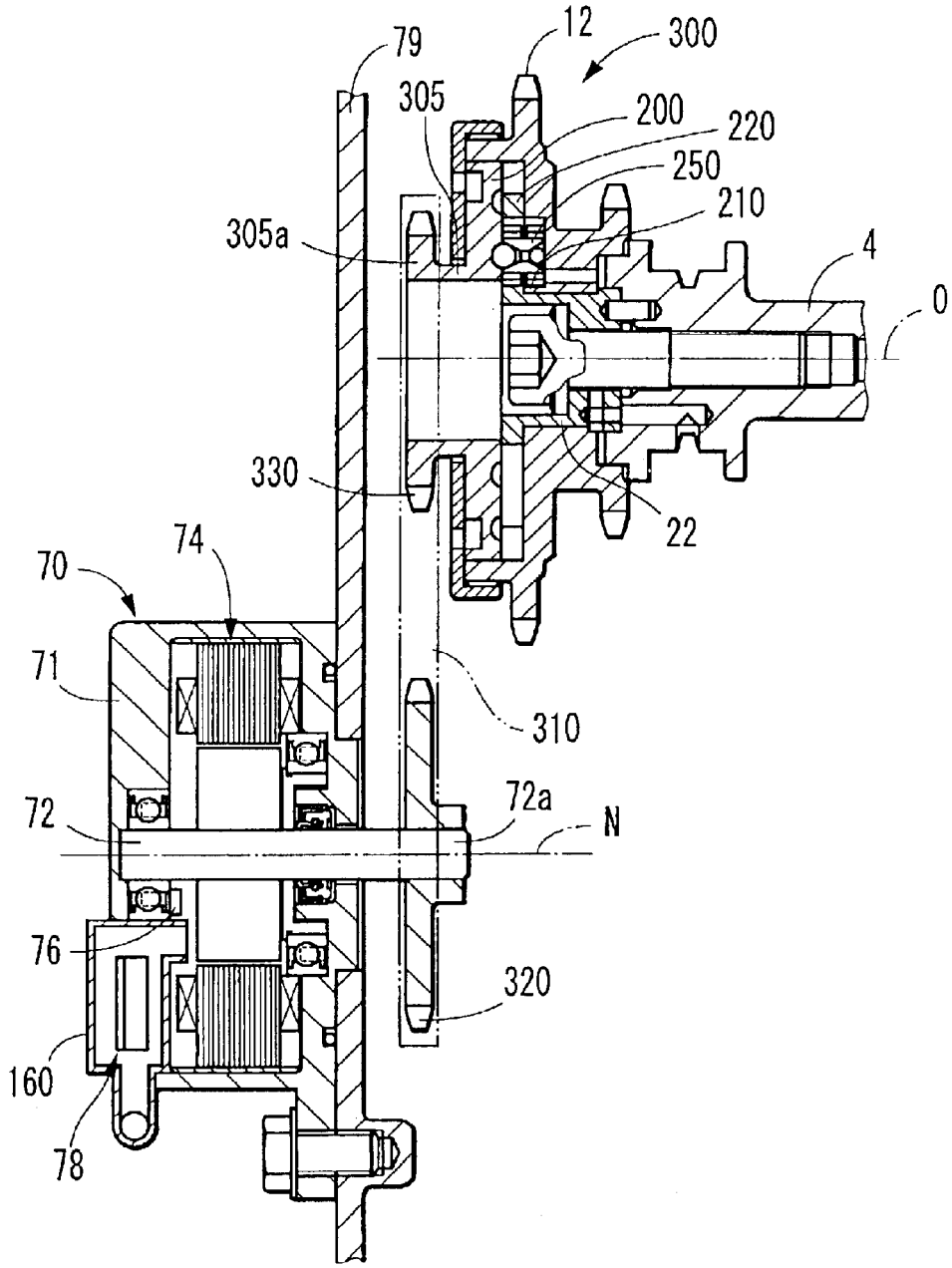
FIG. 20 is a cross sectional view showing a valve timing adjusting device according to a fifth embodiment of the present invention.

A valve timing adjusting device according to a fifth embodiment of the present invention is illustrated in FIG. 20, in which substantially the same constituent portions as in the first and fourth embodiments are identified by like reference numerals.

The valve timing adjusting device 300 of this fifth embodiment is a modification of the valve timing adjusting device 155 of the fourth embodiment. In the valve timing adjusting device 300, a central axis N of an operating shaft 72 is eccentric to a cam axis O. In the valve timing adjusting device 300, the ring gear 14 and the planetary gear 30 in the previous embodiments are not provided, and instead of the eccentric shaft 18 used in the fourth embodiment an input shaft 305 is integral with a rotatable member 200 concentrically. Further, in the valve timing adjusting device 300, a chain 310 as an annular member is used instead of the shaft coupling 170 in the fourth embodiment in order to interconnect the operating shaft 72 and the input shaft 305. The chain 310 is stretched between and entrained on both a sprocket 320 mounted on an end portion 72*a* of the operating shaft 72 concentrically and a sprocket 330 mounted on an end portion 305*a* of the input shaft 305 concentrically. Through the chain 310 the operating shaft 72 and the input shaft 305 are interconnected for synchronous operation.

When coils 90 are de-energized during rotation of a sprocket 12 with a driving torque and no torque is applied to the operating shaft 72 by an electromagnetic unit 74, the input shaft 305 which rotates together with the sprocket 12 causes the operating shaft 72 to rotate synchronously through the chain 310. On the other hand, when the coils 90 are energized during rotation of the sprocket 12 and the first or the second torque is applied to the operating shaft 72 by the electromagnetic unit 74, the applied torque is transmitted from the operating shaft 72 to the input shaft 305 through the chain 310. As a result, the input shaft 305 rotates relatively in a delay direction Y or in an advance direction X with respect to the sprocket 12.

Thus, in this embodiment, the input shaft 305, rotatable member 200, converting portions 210, 220 and control pins 250 conjointly constitute a phase change means.

According to the valve timing adjusting device 300 described above, the transfer of torque between the operating shaft 72 and the input shaft 305 can be attained positively through the chain 310. Besides, according to the valve timing adjusting device 300, since the chain 310 can be attached to and detached from the sprockets 320 and 330 on the operating shaft 72 and the input shaft 305, an electric motor 70 can be easily mounted and removed with respect to the other components of the valve timing adjusting device 300 and therefore the maintainability is improved.

The chain 310 and the sprockets 320, 330 may be substituted by, for example, a belt as an annular member and pulleys, respectively.

Sixth Embodiment

Figure 21:
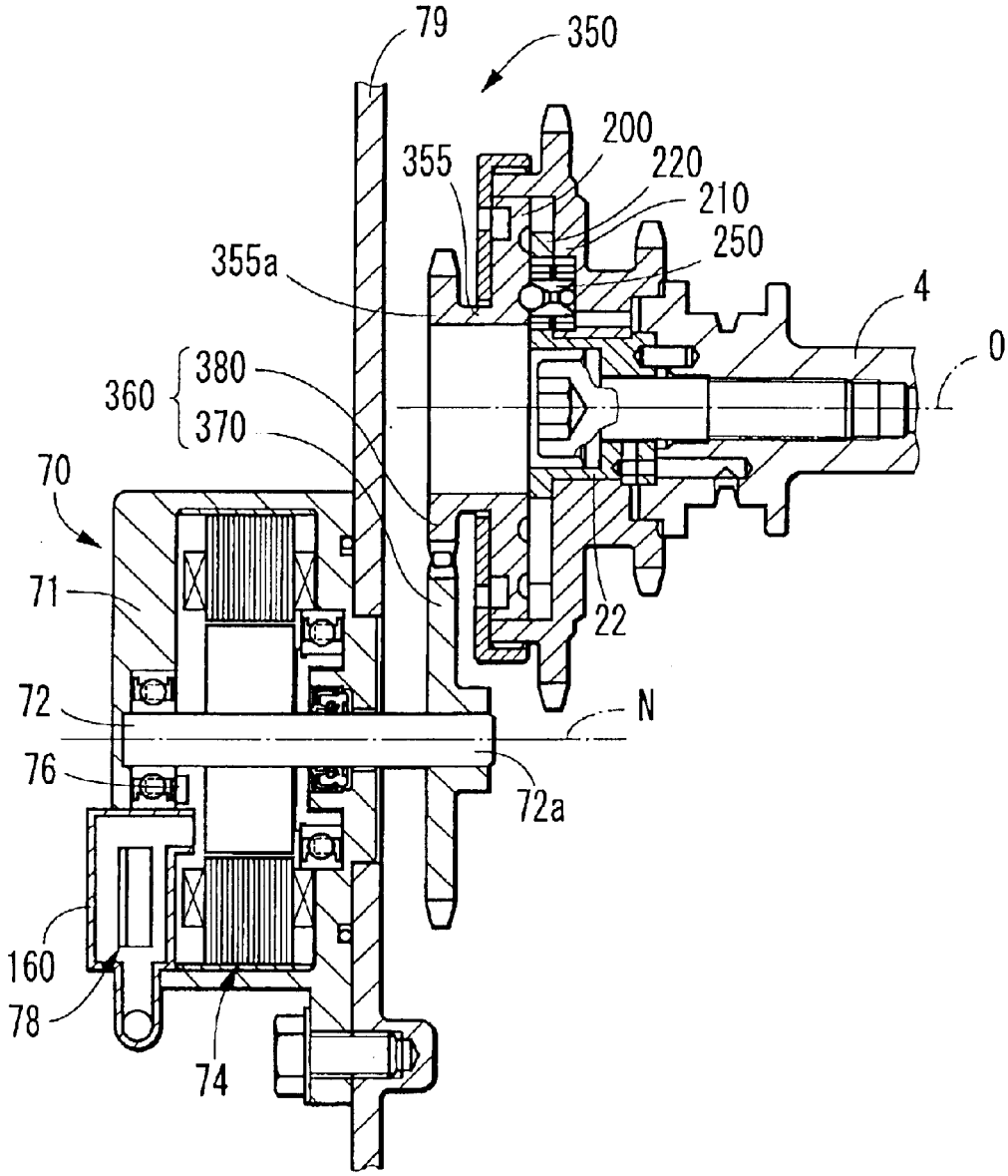
FIG. 21 is a cross sectional view showing a valve timing adjusting device according to a sixth embodiment of the present invention.

A valve timing adjusting device according to a sixth embodiment of the present invention is illustrated in FIG. 21, in which substantially the same constituent portions as in the first and fourth embodiments are identified by like reference numerals.

The valve timing adjusting device 350 of this sixth embodiment is a modification of the valve timing adjusting device 155 of the fourth embodiment. In the valve timing adjusting device 350, a central axis N of an operating shaft 72 is eccentric to a cam axis O. In the valve timing adjusting device 350, moreover, the ring gear 14 and the planetary gear 30 are not used and an input shaft 355 is integral with a rotatable member 200 concentrically instead of the eccentric shaft 18 used in the fourth embodiment. Further, in the valve timing adjusting device 350, the shaft coupling 170 used in the fourth embodiment is substituted by a gear mechanism 360 in order to interconnect the operating shaft 72 and the input shaft 355. The gear mechanism 360 has a gear 370 mounted concentrically on an end portion 72*a* of the operating shaft 72 and also has a gear 380 mounted concentrically on an end portion 355*a* of the input shaft 355, the gears 370 and 380 being in mesh with each other removably. With this engagement of both gears 370 and 380, the operating shaft 72 and the input shaft 355 are interconnected for synchronous operation.

When coils 90 de-energized during rotation of a sprocket 12 with a driving torque and no torque is applied to the operating shaft 72 by an electromagnetic unit 74, the input shaft 355 which rotates together with the sprocket 12 causes the operating shaft 72 to rotate synchronously through the gear mechanism 360. On the other hand, during rotation of the sprocket 12, if the coils 90 are energized and the first or the second torque is applied to the operating shaft 72 by the electromagnetic unit 74, the applied torque is transmitted from the operating shaft 72 to the input shaft 355 through the gear mechanism 360. This allows the input shaft 355 to rotate relatively in the delay direction Y or in the advance direction X with respect to the sprocket 12.

Thus, in this embodiment, the input shaft 355, rotatable member 200, converting portions 210, 220 and control pins 250 conjointly constitute a phase change means.

According to the valve timing adjusting device 350 described above, the transfer of torque between the operating shaft 72 and the input shaft 355 can be attained positively through the gear mechanism 360. In the valve timing adjusting device 350, moreover, since the gears 370 and 380 mounted on the operating shaft 72 and the input shaft 355 respectively are engaged with each other, an electric motor 70 can be mounted and removed easily with respect to the other components of the valve timing adjusting device 350.

Seventh Embodiment

Figure 22:
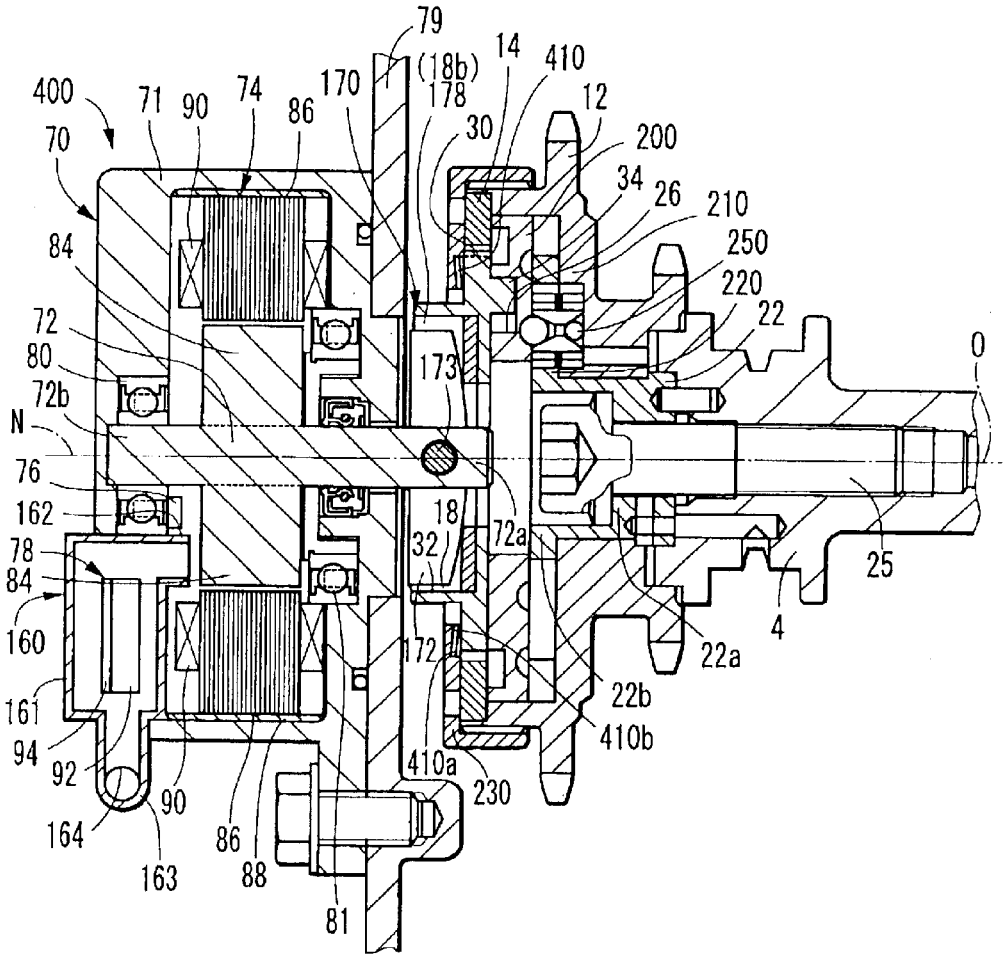
FIG. 22 is a cross sectional view showing a valve timing adjusting device according to a seventh embodiment of the present invention.

A valve timing adjusting device according to a seventh embodiment of the present invention is illustrated in FIG. 22, in which substantially the same components as in the first and fourth embodiments are identified by like reference numerals.

The valve timing adjusting device 400 of this seventh embodiment is a modification of the valve timing adjusting device 155 of the fourth embodiment. In the valve timing adjusting device 400, a planetary gear 30 constitutes a transfer member for the transfer of torque between an eccentric shaft 18 and an output shaft 22, and a resilient member 410 constituted by a coned disc spring is interposed as a friction member between the planetary gear 30 and a cover 230 which is fixed to a sprocket 12. An end portion 410*a* on a large diameter side of the resilient member 410 is fixed to the cover 230, while an end portion 410*b* on a small diameter side of the resilient member 410 is pushed for slide contact against an outer wall on an anti-engagement side of the planetary gear 30. Therefore, if the planetary gear 30 tries to rotate relatively with respect to the sprocket 12 and the cover 230, the resilient member 410 undergoes an resilient deformation and a frictional force proportional to the resilient characteristic of the resilient member 410 is created in the slide contact portion between the resilient member 410 and the planetary gear 30, i.e., between the cover 230 and the planetary gear 30. In this embodiment, the sprocket 12 and the cover 230 conjointly constitute a drive-side rotor.

In the valve timing adjusting device 155 of this fourth embodiment, an engine torque transferred from a camshaft 4 to an output shaft 22 is difficult to be transmitted up to an eccentric shaft 18, so the eccentric shaft 18 does not rotate under an abruptly changing engine torque, but is rotated by the operating shaft 72 which tends to continue rotation by virtue of inertia. In this case, the phase of the camshaft 4 with respect to the crankshaft changes. However, in the valve timing adjusting device 400 of this seventh embodiment, the rotation of the planetary gear 30 caused by inertia of the operating shaft 72 upon sudden change of the engine torque and hence the rotation of the eccentric shaft 18 caused by the rotation of the planetary gear 30 can be counteracted by the frictional force obtained by the resilient member 410. Consequently, the phase of the camshaft 4 relative to the crankshaft can be controlled with high accuracy. But, in the valve timing adjusting device 400, the first and second torques to be applied to the operating shaft 72 are controlled by a current-supply control unit 78 taking into account the frictional force created by the resilient member 410.

The friction member is not limited to the resilient member 410 constituted by a coned disc spring. There may be adopted any other friction member insofar as it comes into sliding contact with a transfer member such as the eccentric shaft 18 as an input shaft or the planetary gear 30 for the transfer of torque between the eccentric shaft 8 and the output shaft 22 as a driven-side rotor, and generates a frictional force.

Eighth Embodiment

Figure 23:
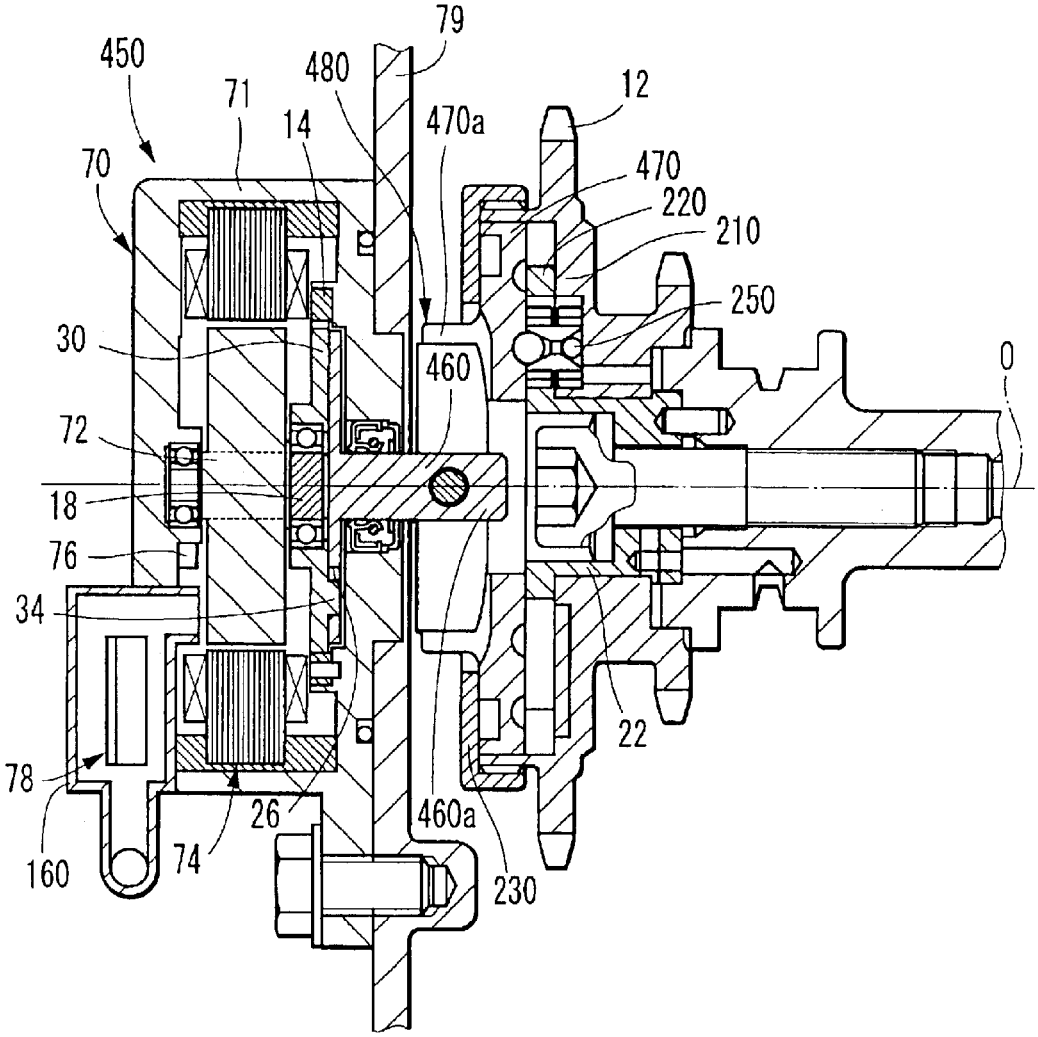
FIG. 23 is a cross sectional view showing a valve timing adjusting device according to an eighth embodiment of the present invention.

A valve timing adjusting device according to an eighth embodiment of the present invention is illustrated in FIG. 23, in which substantially the same constituent portions as in the first and fourth embodiments are identified by like reference numerals.

The valve timing adjusting device 450 of this eighth embodiment is a modification of the valve timing adjusting device 155 of the fourth embodiment. In the valve timing adjusting device 450, an operating shaft 72 is fixed directly to an eccentric shaft 18. Moreover, in the rotatable member 200 used in the fourth embodiment, the portion engaged with the planetary gear 30 and the portion connected with the control pins 250 are separated from each other as a first rotatable member 460 and a second rotatable member 470, respectively. Ring gear 14, eccentric shaft 18, planetary gear 30, and first rotatable member 460 are received within a housing 71 of an electric motor 70, of which ring gear 14 is fixed to the housing 71.

Further, an end portion 460*a* on an anti-planetary gear side of the first rotatable member 460 and an end portion 470*a* on an anti-control pin side of the second rotatable member are formed as concentrically extending shafts and are connected together through a shaft coupling 480 which is constructed in accordance with the shaft coupling 170 used in the fourth embodiment.

In the valve timing adjusting device 450, the ring gear 14, eccentric shaft 18, planetary gear 30, and first rotatable member 460 conjointly constitute a reduction mechanism free of axial displacement, and the reduction mechanism is received within the housing 71 which houses therein an electromagnetic unit 74 of the electric motor 70.

The reduction mechanism composed of the components 14, 18, 30, and 460, as well as the second rotatable member 470, converting portions 210, 220 and control pins 250, conjointly constitute a phase change means.

The present invention has been described above by way of plural embodiments, but as to the phase change means there may be adopted a construction other than the above constructions insofar as the construction adopted can fulfill the function of converting a relative rotational motion of an input shaft into a relative rotational motion of a driven-side rotor with respect to a drive-side rotor and thereby changing a rotational phase of a driven shaft relative to a drive shaft. For example, there may be adopted the construction disclosed in JP-A-2002-227615.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A valve timing adjusting device provided in a transmission system for the transfer of a driving torque of a drive shaft in an internal combustion engine to a driven shaft which actuates at least one of an intake valve and an exhaust valve for opening and closing motions, to adjust an opening/closing timing of the at least one of the intake valve and the exhaust valve, the valve timing adjusting device comprising:

a rotatable member adapted to rotate about an axis of the driven shaft with the driving torque of the drive shaft, the rotatable member having an internal gear concentrically with an axis of the driven shaft;

an eccentric shaft eccentric to the axis of the driven shaft and adapted to rotate about the axis of the driven shaft with rotation of the rotatable member;

a planetary gear supported by an outer periphery wall of the eccentric shaft so as to be relatively rotatable about an axis of the eccentric shaft and adapted to rotate about the axis of the driven shaft with rotation of the rotatable member by meshing with the internal gear;

an output shaft connected to the driven shaft and adapted to rotate about the axis of the driven shaft integrally with the driven shaft with rotation of the planetary gear by engagement with the planetary gear;

an operating shaft connected to the eccentric shaft and adapted to rotate about the axis of the driven shaft integrally with the eccentric shaft; and an electromagnetic unit fixed to the internal combustion engine so as not to be displaced, the electromagnetic unit causing a magnetic field to be generated along an outer periphery of the operating shaft by the supply of an electric current and thereby applying to the operating shaft a first torque acting in a direction opposite to the rotational direction of the operating shaft and a second torque acting in the rotational direction of the operating shaft, wherein when the electromagnetic unit applies the first torque to the operating shaft in a rotating state of the shaft, the operating shaft and the eccentric shaft rotate relatively in a delay direction with respect to the rotatable member, whereby the planetary gear rotates relatively in an advance direction together with the output shaft and the driven shaft with respect to the rotatable member while rotating relatively in the advance direction with respect to the eccentric shaft, and when the electromagnetic unit applies the second torque to the operating shaft in a rotating state of the shaft, the operating shaft and the eccentric shaft rotate relatively in the advance direction with respect to the rotatable member, whereby the planetary gear rotates relatively in the delay direction together with the output shaft and the driven shaft with respect to the rotatable member while rotating relatively in the delay direction with respect to the eccentric shaft.

2. A valve timing adjusting device according to claim 1, further comprising a current-supply control unit for controlling the supply of an electric current to the electromagnetic unit.

3. A valve timing adjusting device according to claim 2, wherein the operating shaft, the electromagnetic unit which supports the operating shaft rotatably, and the current-supply control unit which is bonded to the electromagnetic unit, constitute an electric motor.

4. A valve timing adjusting device according to claim 2, further comprising a sensor unit for detecting a rotational angle of the operating shaft, and wherein the current-supply control unit controls the supply of an electric current to the electromagnetic unit on the basis of the rotational angle detected by the sensor unit.

5. A valve timing adjusting device according to claim 1, wherein the operating shaft is provided on an outer periphery thereof with a magnet for forming a magnetic pole.

6. A valve timing adjusting device according to claim 5, wherein the magnet is constituted by a rare earth magnet.

7. A valve timing adjusting device according to claim 1, further comprising a friction member that enhances a frictional force between the rotatable member and at least one of the planetary gear and the output shaft both adapted to rotate relatively with respect to the rotatable member.

8. A valve timing adjusting device according to claim 1, wherein:

the output shaft has at least one engaging hole of a circular section around the axis of the driven shaft;

the planetary gear has at least one engaging lug of a circular section around the axis of the eccentric shaft, the engaging lug being for insertion into the engaging hole as a corresponding engaging hole through an opening of the engaging hole; and an inner periphery wall of the engaging hole and an outer periphery wall of the engaging lug corresponding to each other are engaged with each other, whereby the output shaft comes into engagement with the planetary gear.

9. A valve timing adjusting device according to claim 8, further comprising an urging means, and wherein the inner periphery wall of the engaging hole is tapered so as to be larger in diameter toward the opening of the engaging hole into which the engaging lug is inserted, the outer periphery of the engaging lug is tapered so as to be smaller in diameter toward a projecting tip portion, and the engaging lug is formed on the planetary gear so as to be movable toward both sides in a central axis direction of the lug and is urged in the direction of insertion into the engaging hole by the urging means.

10. A valve timing adjusting device provided in a transmission system that transmits a driving torque of a drive shaft of an internal combustion engine to a driven shaft, which drives at least one of an intake valve and an exhaust valve, wherein the valve timing adjusting device adjusts an opening/closing timing of the at least one of the intake valve and the exhaust valve, the valve timing adjusting device comprising:

a drive-side rotor that is rotated by the driving torque of the drive shaft;

a driven-side rotor that is rotated together with the driven shaft by the driving torque transmitted from the drive-side rotor;

a phase change means for changing a rotational phase of the driven shaft relative to the drive-side rotor, wherein the phase change means includes an input shaft:

an operating shaft that is connected to the input shaft; and an electromagnetic unit that is fixed stationary to the internal combustion engine, wherein the electromagnetic unit generates a magnetic field to apply a rotational torque to the operating shaft in a selected one of two opposite directions upon supply of electric current, thereby to change an rpm of the input shaft relative to an rpm of the drive-side rotor, so that the input shaft rotates relative to the drive-side rotor, wherein:

when a difference exists between the rpm of the input shaft and the rpm of the drive-side rotor, the phase change means converts the relative rotational motion of the input shaft to relative rotational motion of the driven-side rotor with respect to the drive-side rotor, to change the rotational phase of the driven shaft relative to the drive-side rotor.

11. A valve timing adjusting device according to claim 10, wherein the operating shaft and the electromagnetic unit constitute an electric motor, the electric motor capable of being mounted and removed with respect to the other components of the valve timing adjusting device.

12. A valve timing adjusting device according to claim 11, wherein the operating shaft and the input shaft are interconnected through a shaft coupling.

13. A valve timing adjusting device according to claim 11, wherein the operating shaft and the input shaft are interconnected through an annular member which is stretched between and entrained on both said shafts.

14. A valve timing adjusting device according to claim 11, wherein the operating shaft and the input shaft are interconnected by the engagement of gears mounted on both said shafts respectively.

15. A valve timing adjusting device according to claim 11, wherein the phase change means has a reduction mechanism for decreasing the rotational speed of the input shaft.

16. A valve timing adjusting device according to claim 15, wherein components of the reduction mechanism are incapable of displacement in the axial direction of the input shaft.

17. A valve timing adjusting device according to claim 10, further comprising a current-supply control unit for controlling the supply of an electric current to the electromagnetic unit.

18. A valve timing adjusting device according to claim 17, further comprising a case for receiving the current-supply control unit therein, the case being bonded to a receptacle housing of the electromagnetic unit so as to permit the admission therein of a current of air created by rotation of the operating shaft.

19. A valve timing adjusting device according to claim 18, wherein the case has an inlet passage and an outlet passage on upper and lower sides, respectively, in the vertical direction so that the current of air created by rotation of the operating shaft is admitted into the inlet passage and is drawn out to the exterior from the outlet passage.

20. A valve timing adjusting device according to claim 19, wherein the outlet passage forms at least one bent portion.

21. A valve timing adjusting device according to claim 10, wherein the phase change means has a transfer member for the transfer of torque between the input shaft and the driven-side rotor and a friction member that enhances a frictional force between the transfer member or the input shaft and the drive-side rotor.

22. A valve timing device according to claim 21, wherein the friction member is constituted by a resilient member which generates the frictional force by a resilient deformation.

23. A valve timing device according to claim 10, wherein when electric current is not supplied to the electromagnetic unit, the rpm of the input shaft is the same as the rpm of the drive-side rotor.

* * * * *